US011313653B2

(12) United States Patent
Kash et al.

(10) Patent No.: US 11,313,653 B2
(45) Date of Patent: Apr. 26, 2022

(54) INITIATOR ASSEMBLIES FOR A PERFORATING GUN

(71) Applicant: G&H Diversified Manufacturing LP, Houston, TX (US)

(72) Inventors: James Edward Kash, Houston, TX (US); Benjamin Vascal Knight, Houston, TX (US); Ryan Ward, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 17/153,701

(22) Filed: Jan. 20, 2021

(65) Prior Publication Data

US 2021/0223007 A1 Jul. 22, 2021

Related U.S. Application Data

(60) Provisional application No. 62/963,527, filed on Jan. 20, 2020.

(51) Int. Cl.

| | |
|---|---|
| ***F42B 3/103*** | (2006.01) |
| ***E21B 43/1185*** | (2006.01) |
| ***F42B 3/198*** | (2006.01) |

(52) U.S. Cl.

CPC ..... *F42B 3/103* (2013.01); *E21B 43/1185* (2013.01); *F42B 3/198* (2013.01)

(58) Field of Classification Search

CPC ..... F42B 3/103; F42B 3/198; E21B 43/1185

See application file for complete search history.

(56) References Cited

U.S. PATENT DOCUMENTS

| | | | | |
|---|---|---|---|---|
| 4,100,978 A * | 7/1978 | Boop | E21B 43/1185 | 102/306 |
| 4,369,707 A * | 1/1983 | Budde | F42B 3/182 | 102/202.2 |
| 4,441,427 A * | 4/1984 | Barrett | F42B 3/192 | 102/202.6 |
| 5,831,203 A * | 11/1998 | Ewick | F42B 3/10 | 102/202.5 |
| 6,752,083 B1 * | 6/2004 | Lerche | E21B 43/1185 | 102/202.5 |

(Continued)

OTHER PUBLICATIONS

International Search Report and Written Opinion dated May 3, 2021, for Application No. PCT/US2021/014212.

*Primary Examiner* — Joshua T Semick

(74) *Attorney, Agent, or Firm* — Conley Rose, P.C.

(57) ABSTRACT

An initiator assembly for a perforating gun includes a detonator configured to detonate a shaped charge of the perforating gun when ballistically coupled to the shaped charge, wherein the detonator includes a detonator housing that receives an explosive material and a detonator electrical connector extending from the detonator housing, and a switch assembly configured to detonate the detonator after receiving a firing signal, wherein the switch assembly includes a switch housing and a switch electrical connector received in the switch housing, wherein one of the detonator electrical connector and the switch electrical connector is insertable into the other of the detonator electrical connector and the switch electrical connector to form an electrical connection between the detonator and the switch assembly.

22 Claims, 12 Drawing Sheets

(56) References Cited

U.S. PATENT DOCUMENTS

| | | | | |
|---|---|---|---|---|
| 8,091,477 | B2 * | 1/2012 | Brooks | F42B 3/121 102/202.7 |
| 8,468,944 | B2 * | 6/2013 | Givens | F42B 3/121 102/275.11 |
| 8,601,948 | B2 * | 12/2013 | Spring | F42B 3/14 102/202.2 |
| 8,661,978 | B2 * | 3/2014 | Backhus | F42D 1/05 102/202.3 |
| 9,664,491 | B2 * | 5/2017 | DeVries | F42C 19/12 |
| 9,822,618 | B2 * | 11/2017 | Eitschberger | E21B 43/1185 |
| 10,400,558 | B1 * | 9/2019 | Shahinpour | F42B 3/192 |
| 10,584,950 | B2 * | 3/2020 | Saltarelli | E21B 43/1185 |
| 10,767,453 | B2 * | 9/2020 | Phelps | H05K 1/11 |
| 10,801,308 | B2 * | 10/2020 | Hardesty | E21B 43/116 |
| 10,830,566 | B2 * | 11/2020 | Maxted | F42D 1/043 |
| 11,078,765 | B2 * | 8/2021 | Davis | E21B 43/116 |
| 2015/0260496 | A1 | 9/2015 | Backhus et al. | |
| 2017/0016703 | A1 | 1/2017 | Mace et al. | |
| 2019/0085664 | A1 * | 3/2019 | Hardesty | E21B 43/116 |
| 2019/0195054 | A1 * | 6/2019 | Bradley | E21B 43/1185 |
| 2019/0212118 | A1 | 7/2019 | Saltarelli et al. | |
| 2019/0292886 | A1 | 9/2019 | Shahinpour et al. | |
| 2019/0360315 | A1 | 11/2019 | Hardesty | |
| 2021/0164331 | A1 * | 6/2021 | Sokolove | F42B 3/182 |

* cited by examiner

INITIATOR ASSEMBLIES FOR A PERFORATING GUN

CROSS-REFERENCE TO RELATED APPLICATIONS

This application claims benefit of U.S. provisional patent application Ser. No. 62/963,527 filed Jan. 20, 2020, and entitled "Detonator Assembly for a Perforating Gun System," which is hereby incorporated herein by reference in its entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In order to save time as well as reduce the overall costs of completion activities, it is often desirable to simultaneously lower both a setting tool and at least one perforating gun along the same tool string within the wellbore in order to set the sealing device as well as perforate the wellbore in a single trip downhole. The perforating gun may include one or shaped charges which may be initiated to perforate the wellbore in response to the initiation of a detonator ballistically coupled to the one or more shaped charges.

SUMMARY

An embodiment of an initiator assembly for a perforating gun comprises a detonator configured to detonate a shaped charge of the perforating gun when ballistically coupled to the shaped charge, wherein the detonator comprises a detonator housing that receives an explosive material and a detonator electrical connector extending from the detonator housing, and a switch assembly configured to detonate the detonator after receiving a firing signal, wherein the switch assembly comprises a switch housing and a switch electrical connector received in the switch housing, wherein one of the detonator electrical connector and the switch electrical connector is insertable into the other of the detonator electrical connector and the switch electrical connector to form an electrical connection between the detonator and the switch assembly. In some embodiments, the detonator electrical connector is insertable into the switch electrical connector to form the electrical connection between the detonator and the switch assembly. In some embodiments, the detonator electrical connector comprises a plurality of electrical terminals extending from the detonator housing. In certain embodiments, each of the plurality of terminals extends along a rectilinear central axis. In certain embodiments, the terminals of the detonator are receivable within a plurality of electrical sockets of the switch electrical connector. In some embodiments, the switch housing comprises a detonator receptacle configured to receive the detonator housing of the detonator. In some embodiments, the detonator receptacle comprises an annular ridge configured to interlock with a groove formed on an outer surface of the detonator housing to retain the detonator housing in the detonator receptacle. In some embodiments, the detonator electrical connector slidably electrically contacts the switch electrical connector when the detonator electrical connector is electrically connected to the switch electrical connector.

An embodiment of a initiator assembly for a perforating gun comprises a detonator configured to detonate a shaped charge of the perforating gun when ballistically coupled to the shaped charge, wherein the detonator comprises a detonator housing that receives an explosive material and a detonator electrical connector extending from the detonator housing, and a switch assembly configured to detonate the detonator after receiving a firing signal, wherein the switch assembly comprises a switch housing and a switch electrical connector received in the switch housing, wherein the detonator electrical connector slidably electrically contacts the switch electrical connector when the detonator electrical connector is electrically connected to the switch electrical connector. In some embodiments, the detonator electrical connector comprises a plurality of electrical terminals extending from the detonator housing. In some embodiments, each of the plurality of terminals extends along a rectilinear central axis. In certain embodiments, the terminals of the detonator are receivable within a plurality of electrical sockets of the switch electrical connector. In certain embodiments, the detonator assembly further comprises a plurality of electrical resistors, each resistor having a lead electrically connected to one of the terminals, and each of the terminals is mechanically connected to one of the leads of the resistors. In some embodiments, the switch housing comprises a detonator receptacle configured to receive the detonator housing of the detonator. In some embodiments, the detonator receptacle comprises an annular ridge configured to interlock with a groove formed on an outer surface of the detonator housing to retain the detonator housing in the detonator receptacle. In certain embodiments, one of the detonator electrical connector and the switch electrical connector is insertable into the other of the detonator electrical connector and the switch electrical connector to form an electrical connection between the detonator and the switch assembly.

An embodiment of a method of assembling an initiator assembly for a perforating gun comprises (a) forming a detonator configured to detonate a shaped charge of the perforating gun when ballistically coupled to the shaped charge, wherein the detonator comprises a detonator housing that receives an explosive material and a detonator electrical connector extending from the detonator housing, (b) forming a switch assembly configured to detonate the detonator after receiving a firing signal, wherein the switch assembly comprises a switch housing and a switch electrical connector received in the switch housing, and (c) electrically connecting the detonator with the switch assembly whereby one of the detonator electrical connector and the switch electrical connector is inserted into the other of the detonator electrical connector and the switch electrical connector. In some embodiments, (a) comprises (a1) cutting a plurality of wires extending from the detonator housing to a predefined length, and (a2) stripping insulation from the plurality of wires to form a plurality of electrical terminals comprising the electrical connector of the detonator. In some embodiments, (c) comprises inserting a plurality of electrical terminals comprising the detonator electrical connector into a plurality of electrical sockets comprising the switch electrical connector.

In certain embodiments, (c) comprises electrically connecting the detonator with the switch assembly whereby the detonator electrical connector slidably electrically contacts the switch electrical connector.

BRIEF DESCRIPTION OF THE DRAWINGS

For a detailed description of exemplary embodiments of the disclosure, reference will now be made to the accompanying drawings in which.

DETAILED DESCRIPTION

Figure 1:
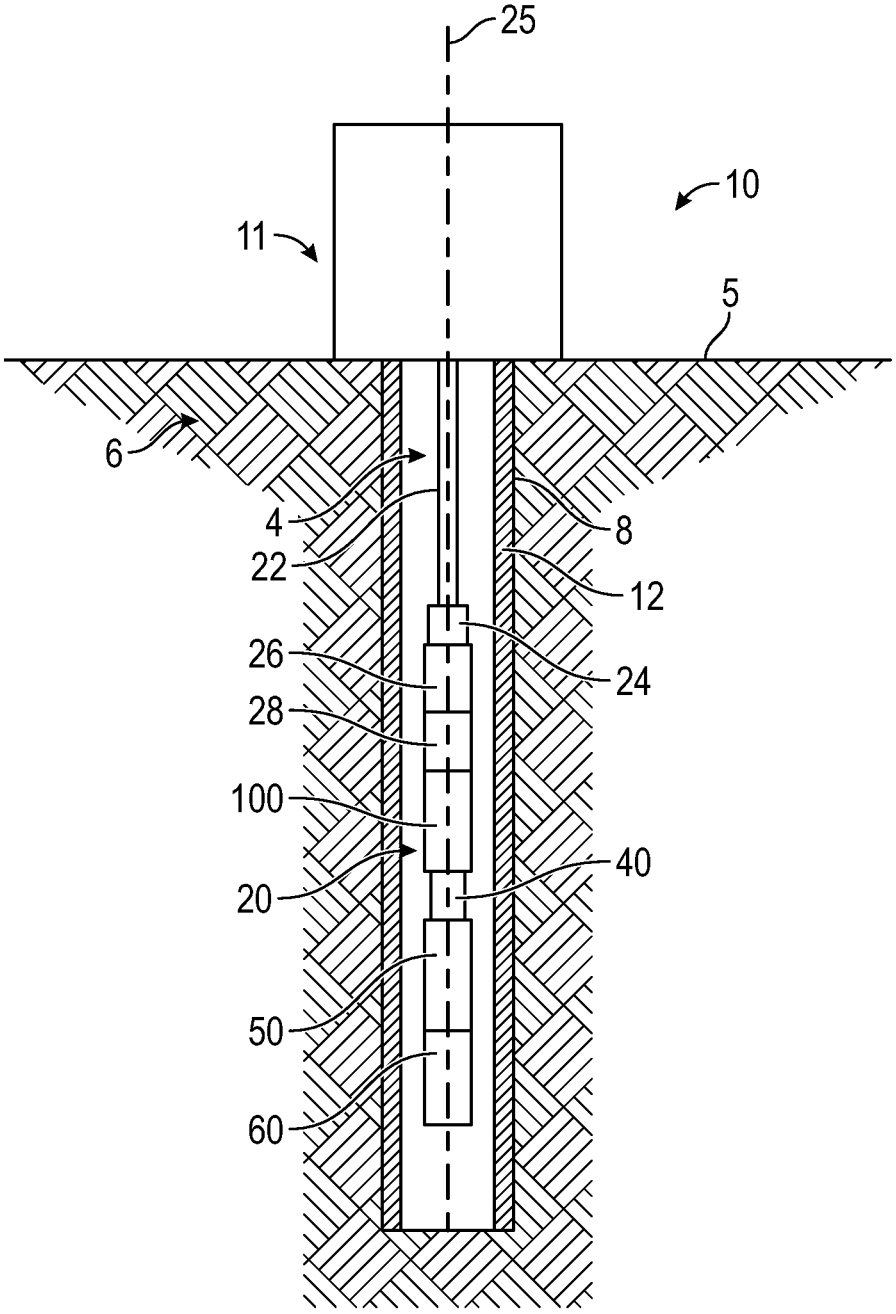
FIG. 1 is a schematic, view of a system for completing a subterranean well including a tool string according to some embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, a system 10 for completing a wellbore 4 extending into a subterranean formation 6 is shown. System 10 may be referred to herein as completion system 10 or perforating gun system 10. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. Completion system 10 includes a surface assembly 11 positioned at a surface 5 and a tool string 20 deployable into wellbore 4 from the surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 4 from a wireline 22 that is extendable/retractable from surface assembly 11. Wireline 22 comprises an armored cable and includes at least one electrical conductor for transmitting power and electrical signals between tool string 20 and a control system or firing panel of surface assembly 11 positioned at the surface 5.

Tool string 20 of system 10 is generally configured to perforate casing string 12 to provide for fluid communication between formation 6 and wellbore 4 at predetermined locations to allow for the subsequent hydraulic fracturing of formation 6 at the predetermined locations. In this embodiment, tool string 20 has a central or longitudinal axis 25 and generally includes a cable head 24, a casing collar locator (CCL) 26, a direct connect sub 28, a perforating gun or tool 100, a plug-shoot firing head (PSFH) 40, a setting tool 50, and a downhole or frac plug 60. Cable head 24 is the uppermost component of tool string 20 and includes an electrical connector for providing electrical signal and power communication between the wireline 22 and the other components (CCL 26, perforating gun 100, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating gun 100 and associated tools, such as the setting tool 50 and downhole plug 60.

As will be discussed further herein, in this exemplary embodiment, perforating gun 100 of tool string 20 is coupled to direct connect sub 28 and is generally configured to perforate casing string 12 and provide for fluid communication between formation 6 and wellbore 4. Particularly, perforating gun 100 includes a plurality of shaped charges that may be detonated by one or more signals conveyed by the wireline 22 from the firing panel of surface assembly 11 to produce one or more explosive jets directed against casing string 12. Perforating gun 100 may comprise a wide variety of sizes such as, for example, 2¾", 3⅛", or 3⅜", wherein the above listed size designations correspond to an outer diameter of perforating gun 100. In this exemplary embodiment, PSFH 40 of tool string 20 is coupled to a lower end of perforating gun 100. PSFH 40 couples the perforating gun 100 of the tool string 20 to the setting tool 50 and downhole plug 60 and is generally configured to pass a signal from the wireline 22 to the setting tool 50 of tool string 20. In this embodiment, PSFH 40 also includes electrical components to fire the setting tool 50 of tool string 20.

In this exemplary embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 4. Once downhole plug 60 has been set by setting tool 50, an outer surface of downhole plug 60 seals against an inner surface of casing string 12 to restrict fluid communication through wellbore 4 across downhole plug 60. Additionally, a slip assembly of downhole plug 60 couples to the inner surface of casing string 12 to affix downhole plug 60 to the casing string 12. Downhole plug 60 of tool string 20 may be any suitable downhole or frac plug known in the art while still complying with the principles disclosed herein.

Figure 2:
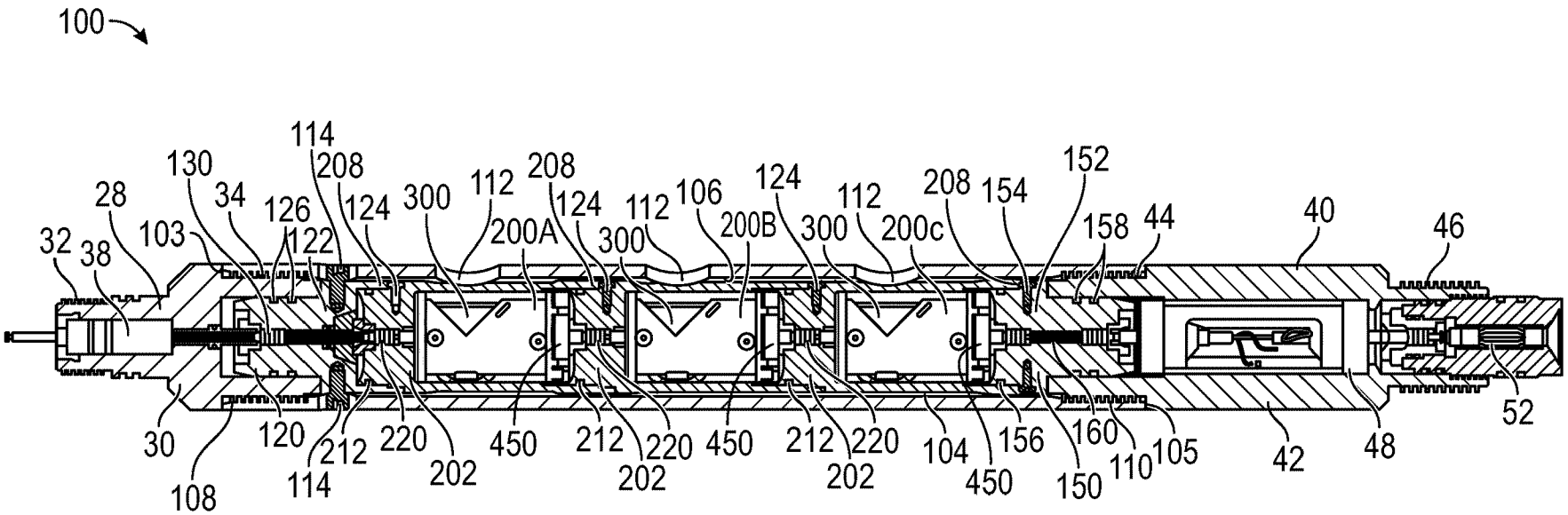
FIG. 2 is a side cross-sectional view of a direct connect sub, a perforating gun, and a plug-shoot firing head of the tool string of FIG. 1 according to some embodiments.

Referring to FIG. 2, an embodiment of the perforating gun 100 of the tool string 20 of FIG. 1 is shown in FIG. 2. In the embodiment of FIG. 2, perforating gun 100 has a central or longitudinal axis which may be coaxial with central axis 25 and generally includes an outer sleeve or housing 102, a first or upper pressure bulkhead 120, a second or lower pressure bulkhead 150, and a plurality of perforator perforating modules 200A-200C each positioned in outer sleeve 102. Although perforating modules 200A-200C are labeled differently in FIG. 2, each perforating module 200A-200C in this exemplary embodiment is similarly configured. In other words, an upper perforating module 200A is configured the same as central perforating module 200B, and lower perforating module 200C. For context, embodiments of the direct connect sub 28, PSFH 40, and a portion of setting tool 50 are also shown in FIG. 2.

In this exemplary embodiment, direct connect sub 28 of tool string 20 generally includes an outer housing 30 and an electrical connector assembly 38 positioned in a central bore or passage of housing 30. Outer housing 30 of direct connect sub 28 is generally cylindrical and includes an outer surface having an external first or upper connector 32 positioned at a first or upper end thereof and an external second or lower connector 34 positioned at an opposing second or lower end thereof. In this exemplary embodiment, connectors 32, 34 each comprise threaded connectors configured for forming a threaded connection with a corresponding internal connector; however, in other embodiments, each may comprise other forms of connectors configured for forming a releasable connection. In this exemplary embodiment, upper connector 32 of direct connect sub 28 threadably connects with a corresponding internal connector of CCL 26 while lower connector 34 of direct connect sub 28 threadably connects to the outer sleeve 102 of perforating gun 100.

The electrical connector 38 of direct connect sub 28 passes electrical power, signals, and/or data between CCL 26 and the perforating modules 200A-200C of perforating gun 100. Additionally, electrical connector 38 seals a central throughbore or passage of the outer housing 30 of direct connect sub 28 whereby pressure within perforating gun 100 is prevented from being communicated uphole through direct connect sub 28 and into CCL 26 and other components of tool string 20 positioned uphole of CCL 26. Thus, electrical connector 38 may shield components of tool string 20 positioned uphole from perforating gun 100 from elevated pressures or shock waves generated by the detonation of shaped charges of perforating gun 100 during the operation of tool string 20.

In this exemplary embodiment, PSFH 40 of tool string 20 generally includes an outer housing 42 and a switch assembly 48 positioned in outer housing 42. Outer housing 42 of PSFH 40 is generally cylindrical and includes an outer surface having an external first or upper connector 44 positioned at a first or upper end of outer housing 42 and an external second or lower connector 46 positioned at an opposing second or lower end of outer housing 42. In this embodiment, connectors 44, 46 each comprise threaded connectors configured for forming a threaded connection with a corresponding internal connector; however, in other embodiments, each may comprise other forms of connectors configured for forming a releasable connection. Upper connector 44 of PSFH 40 threadably connects with outer sleeve 102 of perforating gun 100 while lower connector 46 threadably connects to a corresponding internal connector of setting tool 50 (partially shown in FIG. 2).

In this exemplary embodiment, the switch assembly 48 of PSFH 40 comprises an addressable switch which passes electrical power, signals, and/or data between perforating gun 100 and setting tool 50 of tool string 20. Particularly, in response to the transmission of a setting tool firing signal (e.g., a firing signal individually addressed to switch assembly 48) from the firing panel of surface assembly 11 to switch assembly 48, switch assembly 48 initiates or fires an initiator 52 electrically connected to switch assembly 48 to thereby actuate the setting tool 50 which may in turn actuate downhole plug 60 from a run-in configuration to a set configuration in sealing engagement with the inner surface of casing string 12. Thus, switch assembly 48 may control the actuation of setting tool 50 based on signals transmitted to switch assembly 48 from the firing panel of surface assembly 11.

As described above, perforating gun 100 includes an outer sleeve 102 in which pressure bulkheads 120, 150 and perforating modules 200A-200C are received. Outer sleeve 102 of perforating gun 100 is generally cylindrical and has a first or upper end 103, a second or lower end 105 opposite upper end 103, and a central passage or throughbore 104 defined by a generally cylindrical inner surface 106 extending between ends 103, 105. The inner surface 106 of outer sleeve 102 an internal first or upper connector 108 positioned at upper end 103 and an internal second or lower connector 110 positioned at lower end 105 of outer sleeve 102. In this exemplary embodiment, connectors 108, 110 each comprise threaded connectors configured for forming a threaded connection with a corresponding external connector; however, in other embodiments, each may comprise other forms of connectors configured for forming a releasable connection. Upper connector 108 of outer sleeve 102 threadably connects to the lower connector 34 of direct connect sub 28 while lower connector 110 threadably connects to the upper connector 44 of PSFH 40.

In this exemplary embodiment, outer sleeve 102 of perforating gun 100 additionally includes a plurality of axially spaced openings or ports 112, where each port 112 extends radially entirely through the inner surface 106 and an outer generally cylindrical surface of outer sleeve 102. Ports 112 provide openings or passages through which the explosive jets discharged by the shaped charges of perforating gun 100 may be directed as the explosive jets travel towards casing string 12. Given the presence of ports 112, the explosive jets need not physically penetrate outer sleeve 102 in order to escape perforating gun 100. Additionally, in this exemplary embodiment, outer sleeve 102 includes a pair of circumferentially spaced openings through which radial locking members 114 may be inserted for locking the angular position of upper pressure bulkhead 120 relative to outer sleeve 102.

In this embodiment, upper pressure bulkhead 120 of perforating gun 100 generally includes an outer housing 122 and an electrical connector assembly 130 received in a central bore or passage of the outer housing 122. The outer housing 122 comprises a radial aperture configured to receive a radial locking member 124 which rotationally and axially locks upper pressure bulkhead 120 with a first or upper perforating module 200A of the plurality of perforating modules 200A-200C.perforating Outer housing 122 of upper pressure bulkhead 120 additionally includes a pair of annular seals 126 (e.g., O-rings, etc.) disposed on an outer surface thereof which sealingly engage an inner cylindrical surface of the outer housing 30 of direct connect sub 28 whereby fluid communication between the central passage of outer housing 28 and the surrounding environment (e.g., wellbore 4) is restricted. Outer housing 122 further includes a pair of circumferentially spaced apertures which receive the fasteners 114 for coupling and rotationally locking outer sleeve 102 with the outer housing 122 of upper pressure bulkhead 120. For instance, each fastener 114 may threadably engage an internal threaded connector formed in a corresponding aperture of outer housing 122. In this configuration, relative axial movement between upper pressure bulkhead 120 and outer sleeve 102 is restricted.

The electrical connector assembly 130 of upper pressure bulkhead 120 is received in the central passage of outer housing 122 and is generally configured to transmit electrical power, signals, and/or data between direct connect sub 28 and the perforating modules 200A-200C of perforating gun 100. In this exemplary embodiment, electrical connector assembly 130 generally includes a connector body having a pair of annular seals (e.g., O-rings, etc.) positioned on an outer surface thereof, and a biasing member or spring contact electrically connected to the connector body. The seals of electrical connector assembly 130 sealingly engage or contact an inner surface of outer housing 122 whereby fluid communication is prevented across the connector body of electrical connector assembly 130. Additionally, in this exemplary embodiment, the connector body of electrical connector assembly 130 has a first or upper end from which a contact pin extends which electrically contacts a biasing member or spring contact of the electrical connector assembly 38 of direct connect sub 28, and an opposing second or lower end from which the spring contact of electrical connector assembly 130 extends.

Additionally, the connector body of electrical connector assembly 130 comprises a pair of annular shoulders which engage or contact a pair of corresponding internal shoulders of outer housing 122 whereby fluid pressure is restricted or inhibited from being communicated across the connector body. Thus, the connector body is configured to inhibit or prevent elevated pressures and/or shock waves generated by the detonation of the shaped charges of perforating gun 100 from being communicated to components of tool string 20 positioned uphole of perforating modules 200A-200C, including components of CCL 26, direct connect sub 28, etc.

In this embodiment, lower pressure bulkhead 150 of perforating gun 100 generally includes an outer housing 152 and an electrical connector assembly 160 received in a central bore or passage of the outer housing 152. An outer surface of outer housing 152 includes an external connector 154 positioned at the first or upper end of outer housing 152. In this embodiment, connector 154 comprises a threaded connector configured for forming a threaded connection with a corresponding internal connector; however, in other embodiments, connector 154 may comprise other forms of connectors configured for forming a releasable connection. Connector 154 of outer housing 152 threadably connects to lower perforating module 200C of perforating gun 100.

Outer housing 152 of lower pressure bulkhead 150 additionally includes a first or upper annular seal 156 (e.g., O-ring, etc.) and a pair of second or lower annular seals 158 (e.g., O-rings, etc.) each disposed on an outer surface thereof. Upper annular seal 156 sealingly engages an inner cylindrical surface of a third or lower perforating module 200C of the plurality of perforating modules 200A-200C, and the pair of lower annular seals 158 sealingly engage an inner surface of the outer housing 42 of PSFH 40 to restrict fluid communication between the central passage of outer housing 42 and the surrounding environment (e.g., wellbore 4). Further, outer housing 152 includes an annulus formed in the upper end thereof.

The electrical connector assembly 160 of lower pressure bulkhead 150 is received in the central passage of outer housing 152 and is generally configured to transmit electrical power, signals, and/or data between perforating gun 100 and PSFH 40. In this exemplary embodiment, electrical connector assembly 160 generally includes a biasing member or spring contact extending between, and in electrical contact with, a pair of connector bodies and associated annular seals, where the annular seals of each connector body sealingly engage the inner surface of outer housing 152. Additionally, in this exemplary embodiment, a first or upper of the connector bodies of electrical connector assembly 160 is oriented such that the pin contact of the upper connector body extends towards perforating modules 200A-200C to form an electrical connection therewith while a second or lower of the connector bodies of electrical connector assembly 160 extends towards PSFH 40 to form an electrical connection therewith. Similar to the arrangement of the connector body of electrical connector assembly 130 described above, each of the connector bodies of electrical connector assembly 160 is positioned between a pair of shoulders of the outer housing 152 of lower pressure bulkhead 150 whereby pressure is inhibited or restricted from being communicated across the connector bodies of electrical connector assembly 160. Thus, electrical connector assembly 160 shields components of tool string 20 positioned uphole from PSFH 40 (e.g., perforating gun 100, direct connect 28, etc.) from elevated pressures and/or shock waves generated by the detonation of the initiator 52.

Figure 3:
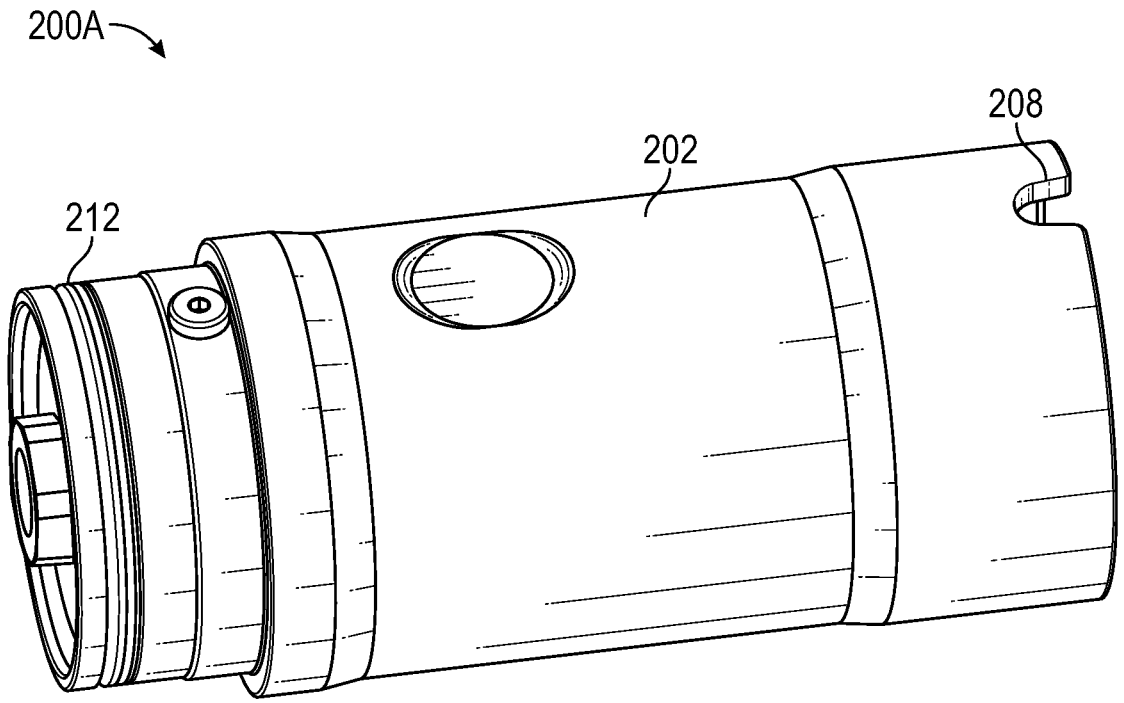
FIG. 3 is a perspective view of a perforating module of the perforating gun of FIG. 2 according to some embodiments.
Figure 4:
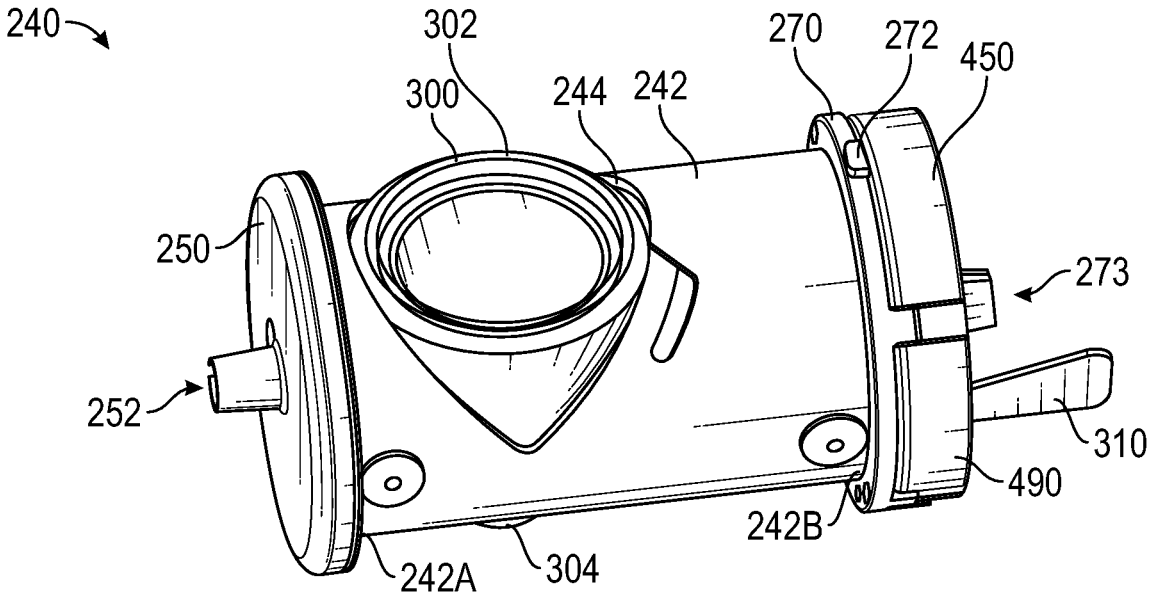
FIGS. 4, 5 are perspective views of a charge tube assembly of the perforating module of FIG. 3 according to some embodiments.
Figure 5:
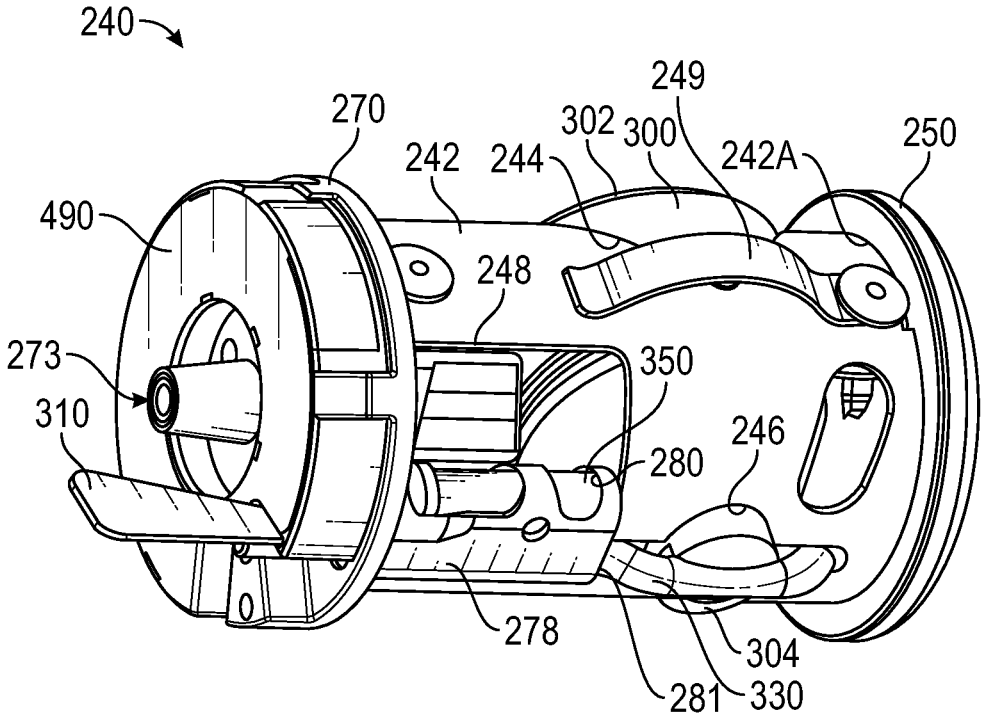
Figure 6:
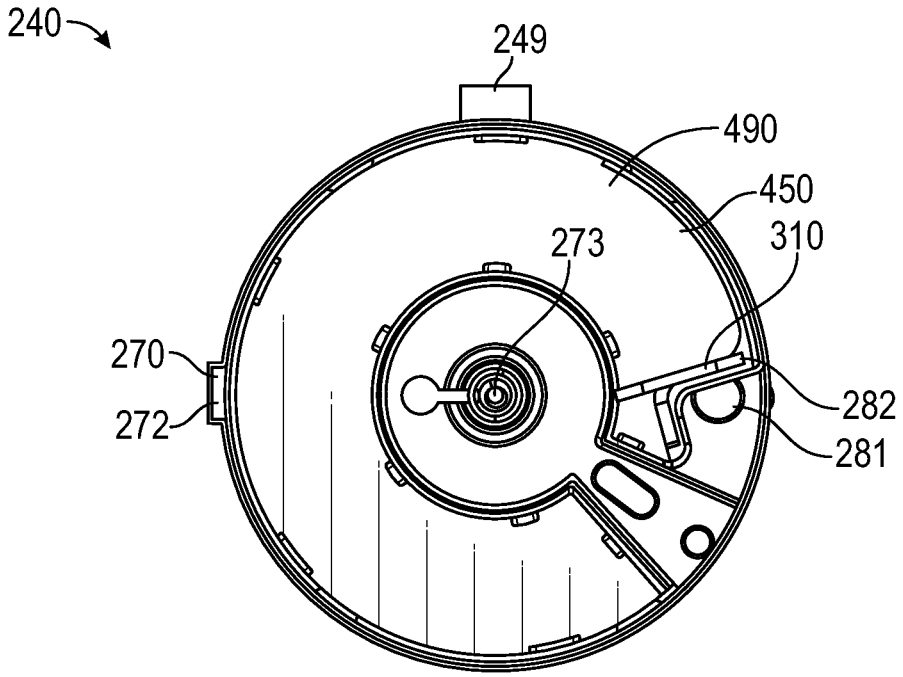
FIGS. 6, 7 are end views of the charge tube assembly of FIGS. 4, 5.
Figure 7:
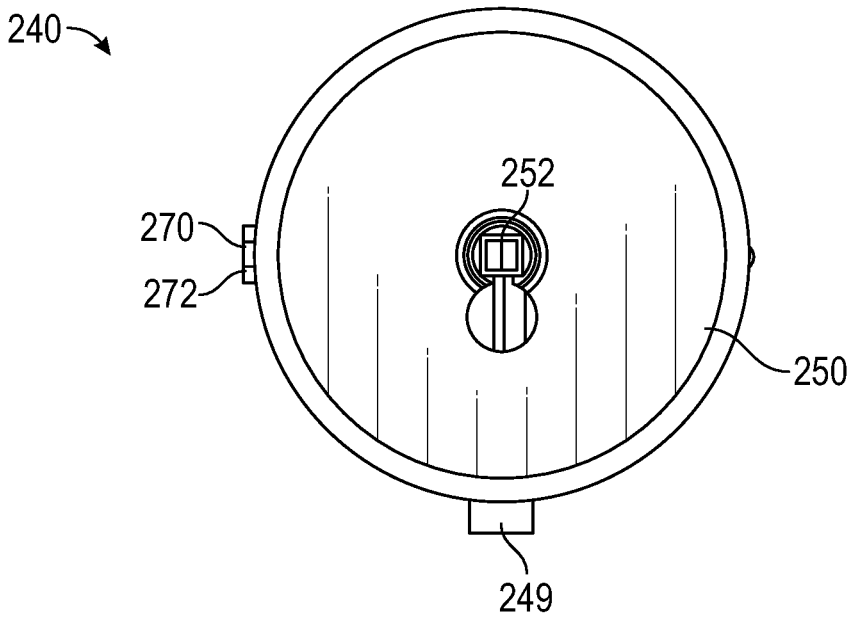
Figure 8:
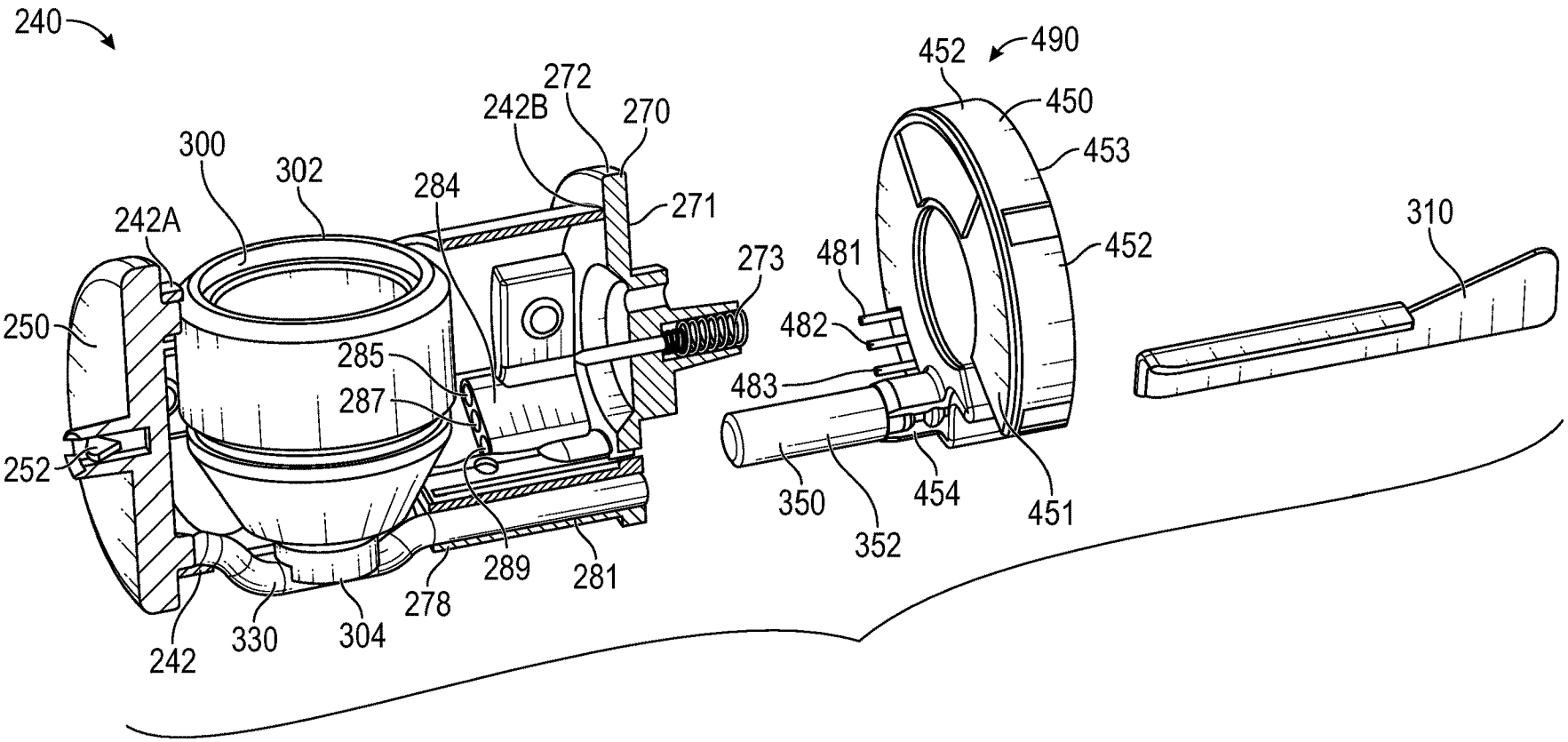
FIGS. 8, 9 are partially exploded cross-sectional views of the charge tube assembly of FIGS. 4, 5.
Figure 9:
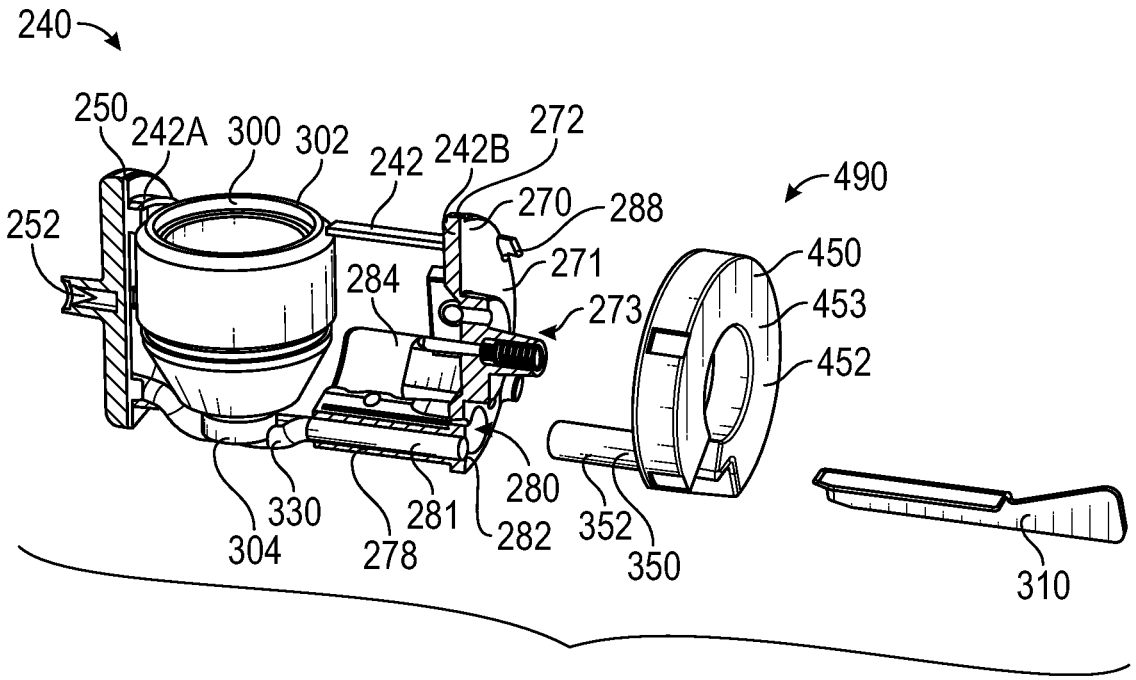

Referring to FIGS. 2, 3, another view of upper perforating module 200A is shown in FIG. 3. In this exemplary embodiment, perforating gun 100 includes three similarly configured perforating modules 200A-200C, each perforating module 200A-200C being slidably received in the outer sleeve 102 of perforating gun 100; however, in other embodiments, perforating gun 100 may comprise a varying number of perforating modules 200 (e.g., 4 to 75 or more perforating modules 200, for example), including only a single perforating module 200 housed within an outer sleeve similar in configuration to outer sleeve 102. In this embodiment, each perforating module 200A-200C generally includes an outer housing or carrier 202, a charge tube assembly 240 housed within the carrier 202 and comprising a single shaped charge 300, a detonator 350, and a switch assembly 450 switch assembly 450. Although in this embodiment each perforating module 200A-200C includes a single shaped charge 300, in other embodiments, each perforating module 200A-200C may include a plurality of shaped charges 300.

The carrier 202 of each perforating module 200A-200C has a first or upper end, a second or lower end opposite upper end, a central bore or passage defined by a generally cylindrical inner surface extending between the ends thereof, and a generally cylindrical outer surface extending between the upper and lower ends thereof. Each carrier 202 includes a radial aperture 208 positioned near the lower end thereof. In this exemplary embodiment, the radial aperture 208 of the carrier 202 of each perforating module 200A-200C receives one of the locking members 124 to restrict relative rotation between the perforating modules 200A-200C. In this manner, locking members 124 may control the angular orientation of perforating modules 200A-200C. As described above, the upper perforating module 200A is rotatably locked to upper pressure bulkhead 120 via a locking member 124, which is in-turn rotatably locked to outer sleeve 102 via locking member 114. Relative axial movement between perforating modules 200A-200C and outer sleeve 102 may be restricted via contact between perforating modules 200A, 200C and shoulders of bulkheads 120, 150.

In this exemplary embodiment, the outer surface of carrier 202 also includes an annular seal 212 (e.g., an O-ring, etc.) positioned thereon and a scallop or indentation which extends partially into outer surface 206. The annular seal 212 of upper perforating module 200A sealingly engages the inner surface of upper pressure bulkhead 120 whereas the annular seals 212 of the remaining two perforating modules 200B, 200C sealingly engage the inner surface of an adjacently positioned carrier 202. The scallop of carrier 202 is circumferentially and axially aligned with a central axis of the shaped charge 300 of the perforating module 200A-200C whereby the detonation of the shaped charge 300 causes the explosive jet to penetrate the scallop of carrier 202. The reduced wall-thickness provided by the scallop assists with the operation of shaped charge 300 in penetrating casing string 12 following the detonation of the shaped charge 300. The connectors 208, 210 of carriers 202 may be sized or otherwise configured whereby the scallops of perforating modules 200A-200C circumferentially align when the carriers 202 of perforating modules 200A-200C are threadably connected.

The carrier 202 of each perforating module 200A-200C also includes an electrical connector assembly 220 which, in this exemplary embodiment, comprises a connector body and a pair of annular seals positioned on an outer surface thereof and which sealingly engage the inner surface of carrier 202. Electrical connector assemblies 220 provide electrical connectivity whereby electrical power, signals, and/or data may be transmitted between perforating modules 200A-200C. Additionally, the connector body of electrical connector assembly 220 is positioned between corresponding shoulders of the inner surface of carrier 202 such that pressure is impeded or prevented from being communicated across the connector body of electrical connector assembly 220.

Thus, electrical connector assembly 220 comprises a pressure bulkhead which isolates the central passage of each carrier 202 from the remaining perforating modules 200A-200C of perforating gun 100. By isolating each perforating module 200A-200C from pressure generated by the remaining perforating modules 200A-200C, each perforating module 200A-200C may be actuated independently of each other without damaging or otherwise impeding the operation of the remaining perforating modules 200A-200C. For example, by isolating the upper and central perforating modules 200A, 200B from pressure generated by lower perforating module 200C, the shaped charge 300 of the lower perforating module 200C may be detonated without damaging or otherwise impeding the future operation of the upper and central perforating modules 200A, 200B of perforating gun 100.

For the sake of convenience, perforating module 200A is described below. However, as previously stated, perforating modules 200A-200C are each similarly configured, and thus, in this exemplary embodiment, the discussion of perforating module 200A below is equally applicable to perforating modules 200B, 200C. Referring to FIGS. 3-9, the charge tube assembly 240 of perforating module 200A generally includes a generally cylindrical charge tube 242, a first or upper endplate 250, a second or lower endplate 270, switch assembly 450 shaped charge 300, and a detonator 350, and switch assembly 450. Charge tube 242 of charge tube assembly 240 has a first or upper end 242A coupled to upper endplate 250, and an opposing second or lower end 242B coupled to lower endplate 270. Endplates 250, 270 may be coupled to the ends 242A, 242B of charge tube 242 via a variety of mechanisms, including rivets, threaded fasteners, etc. In some embodiments, charge tube 242 and endplates 250, 270 may each comprise a metallic material, a plastic material, or combinations thereof. Additionally, in some embodiments, charge tube 242 may be formed monolithically with endplates 250, 270.

Charge tube 242 includes a first radial opening or aperture 244 through which a longitudinal first end 302 (from which the explosive jet is directed following the detonation of shaped charge 300) of the shaped charge 300 projects, and a second radial opening or aperture 246 circumferentially spaced from first radial opening 244 through which a longitudinal second end 304 of shaped charge 300 projects whereby shaped charge 300 is secured to charge tube 242. As will be discussed further herein, charge tube 242 comprises an arcuate slot 248 which extends from lower end 242B towards upper end 242A. Additionally, charge tube 242 also comprises a radial ground spring 249 which extends radially outwards from an outer surface of charge tube 242. In some embodiments, charge tube 242 may comprise a plurality of ground springs 249 spaced circumferentially about the circumference of charge tube 242. A ground wire, not shown, connects the ground spring to the switch assembly 450.

The upper endplate 250 of charge tube assembly 240 is disc-shaped and comprises a centrally positioned electrical connector or socket 252 that electrically connects to the electrical connector assembly 220 of perforating module 200A. For instance, a pin connector extending from the connector body of the electrical connector assembly 220 may extend into electrical socket 252. Electrical socket 252 may comprise one or more inwardly biased pins to secure the pin connector of the connector body of electrical connector assembly 220 within electrical socket 252 such that only a predetermined axial force applied to one of carrier 202 and charge tube assembly 240 may disconnect the connector body from electrical socket 252. A cable or electrical conductor (not shown in FIGS. 3-9) extends from electrical socket 252 to the switch assembly 450 (via connector 298) of upper perforating module 200A whereby electrical power, signals, and/or data may be transmitted between electrical connector assembly 220 and switch assembly 450.

Lower endplate 270 of charge tube assembly 240 is disc-shaped and comprises a planar endface 271, and a radially outwardly extending tab 272 that is received in a slot formed in the inner surface of carrier 202 whereby relative rotation between charge tube assembly 240 and carrier 202 is restricted. Lower endplate 270 additionally includes a centrally positioned electrical connector 273 which comprises a biasing member of spring contact (not shown in FIGS. 3-9) extending axially from charge tube 242 and a pin contact (not shown in FIGS. 3-9) electrically connected to the spring contact thereof and which extends into charge tube 242. A cable or electrical conductor (not shown in FIGS. 3-9) extends from the pin contact of electrical connector 273 to the switch assembly 450 of upper perforating module 200A whereby electrical power, signals, and/or data may be transmitted between switch assembly 450 and central perforating module 200B of perforating gun 100.

In this exemplary embodiment, when perforating gun 100 is assembled, the spring contact of perforating module 200A is biased into electrical contact with the pin connector of the electrical connector assembly 220 of central perforating module 200B, thereby providing an electrical connection between upper perforating module 200A and central perforating module 200B. Similarly, the spring contact of the lower endplate 270 of central perforating module 200B is biased into contact with the pin connector of the electrical connector assembly 220 of lower perforating module 200C, thereby providing an electrical connection between central perforating module 200B and lower perforating module 200C. Finally, the spring contact of the lower endplate 270 of lower perforating module 200C is biased into contact with the pin connector of the electrical connector assembly 130 of lower pressure bulkhead 150, thereby providing an electrical connection between lower perforating module 200C and lower pressure bulkhead 150.

In this embodiment, lower endplate 270 additionally includes a detonator or "det" pack or det holder 278 which extends axially towards upper endplate 250 and may be at least partially received in an arcuate slot 248 of charge tube 240. Det holder 278 comprises a first or detonator receptacle 280 which receives generally cylindrical detonator 350, a second or detcord receptacle 281 which receives at least a portion of a cylindrical detonator cord or detcord 330, and a third or interrupter receptacle 282 (positioned between receptacles 280, 281) which receives a detonator interrupt 310. In this exemplary embodiment, each of receptacles 280, 281, and 282 extend along axes parallel with a central or longitudinal axis of charge tube 240, and do not project radially outwards from lower endplate 270. Detonator 350 is configured to ignite or detonate following switch assembly 450 receiving a firing signal.

In this exemplary embodiment, lower endplate 270 further includes a wiring harness 284 that is received within charge tube 242. As shown particularly in FIG. 8, wiring harness 284 comprises three separate electrical connectors in this embodiment, a first electrical connector 285 which receives the electrical cable extending from electrical socket 252 of upper endplate 250, a second electrical connector 287 which receives the electrical cable extending from pin contact 276 of lower endplate, and a third electrical connector 289 from which an electrical cable or signal conductor (not shown in FIGS. 3-9) extends that is coupled to the ground spring 249.

Figure 10:
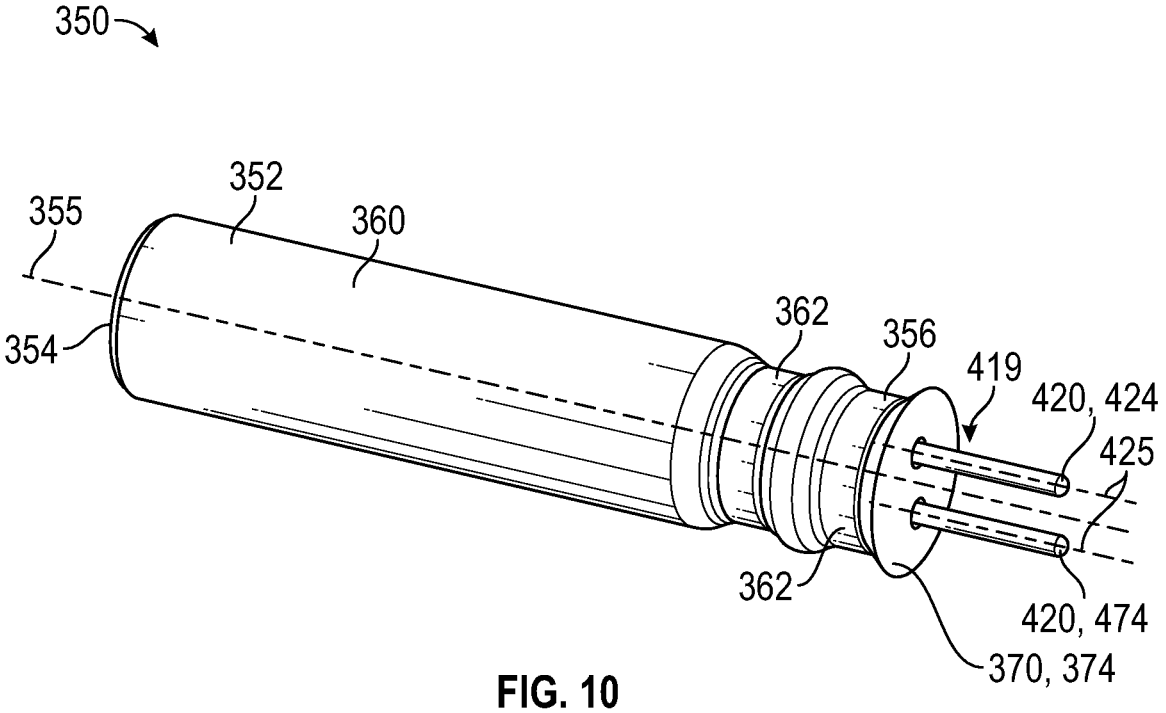
FIG. 10 is a perspective view of a detonator of the charge tube assembly of FIGS. 4, 5 according to some embodiments.
Figure 11:
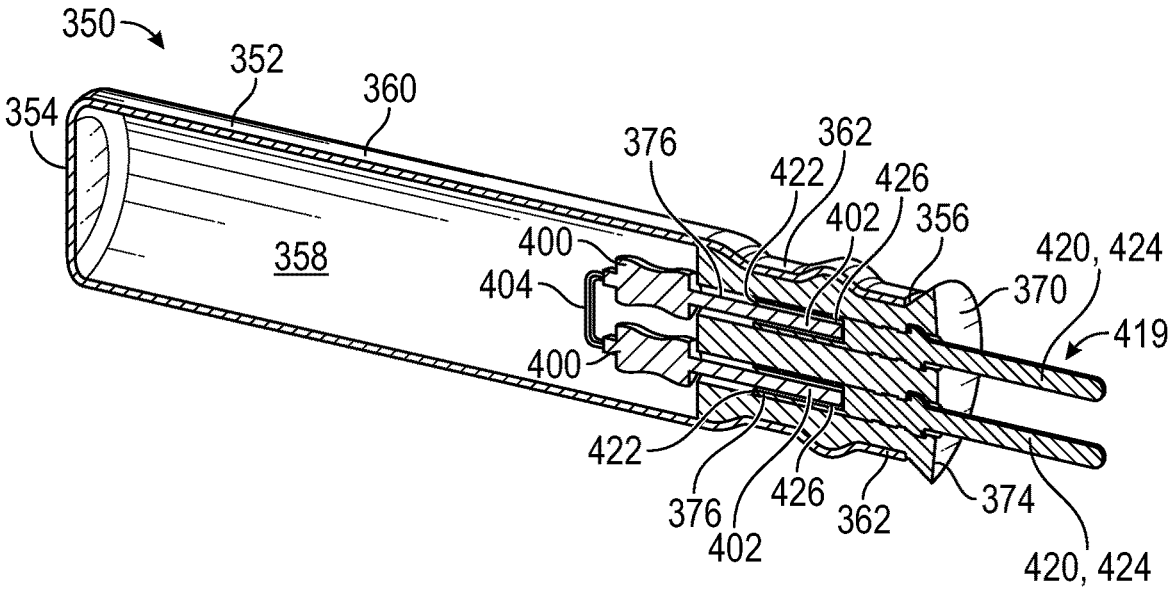
FIG. 11 is a cross-sectional, perspective view of the detonator of FIG. 10.

Referring to FIGS. 10, 11, an embodiment of the detonator 350 of the perforating module 200A is shown. In this exemplary embodiment, detonator 350 has a central or longitudinal axis 355 and generally includes a cylindrical housing 352, a grommet 370, a pair of electrical resistors 400, and an electrical connector 419. Housing 352 of detonator 350 is generally cylindrical and includes a first or upper end 354, a second or lower end 356 opposite upper end 354, and an internal chamber 358 extending into housing 352 from lower end 356. Thus, upper end 354 of housing 352 comprises a closed end 354 while lower end 356 of housing 352 comprises an open end 356. In some embodiments, housing 352 comprises a metallic material, such as aluminum. Chamber 358 of housing 352 is at least partially filled with energetic or explosive materials (not shown in FIGS. 10, 11) configured to ignite or detonate in response to detonator 350 receiving a firing signal from switch assembly 450. In this embodiment, the detonator 350 is positioned directly adjacent det cord 330 and thus may ignite or fire the shaped charge 300 through the det cord 330. However, in other embodiments, detonator 350 may be positioned directly adjacent a shaped charge 300 and thereby directly fire the shaped charge 300 without need of det cord 330.

The grommet 370 of detonator 350 seals chamber 358 of housing 352 from the surrounding environment and affixes or couples electrical connector 419 to housing 352 of detonator 350. Particularly, in this exemplary embodiment, electrical connector 419 of detonator 350 comprises a male electrical connector 419 including a plurality or pair of electrical pins or terminals 420. In some embodiments, grommet 370 comprises an elastomeric material, such as nitrile. Grommet 370 has a first or upper end 372, a second or lower end 374 opposite upper end 372, and a pair of axial passages 376 extending between upper end 372 and lower end 374. In this embodiment, the upper end 372 of grommet 370 is received in chamber 358 of housing 352 while lower end 374 is positioned external of chamber 358 such grommet 370 extends outwardly from the open end 356 of housing 352. An outer surface of grommet 370 extending between ends 372, 374 sealingly engages or contacts an inner surface of housing 352 which defines chamber 358.

In this exemplary embodiment, each electrical resistor 400 comprises an elongate lead 402 which extends into one of the passages 376 of grommet 370 from the upper end 372 thereof. In this exemplary embodiment, electrical resistors 400 are positioned in chamber 358 of housing 352 proximal the upper end 372 of grommet 370. Additionally, a fuse head 404 extends between electrical resistors 400 within chamber 358 of housing 352 to electrically connect the resistors 400.

The terminals 420 of detonator 350 each comprise a central or longitudinal axis 425, a first or upper end 422, and a second or lower end 424 opposite upper end 422. In this embodiment, the central axis 425 of each terminal 420 is rectilinear. Additionally, the central axis 425 of each terminal 420 is offset from but extends parallel with the central axis 355 of detonator 350. In this exemplary embodiment, each terminal 420 comprises a central passage 426 extending partially through the terminal 420 from upper end 422. Each terminal 420 extends partially into one of the passages 376 of grommet 370 whereby the upper end 422 of each terminal 420 is positioned within chamber 358 of housing 352 while the lower end 424 of each terminal 420 is positioned external of chamber 358. Additionally, while the upper end 422 of each terminal 420 is received within one of the passages 376 of grommet 370, the lower end 324 of each terminal 420 is positioned external of each passage 376.

The lead 402 of one of the resistors 400 is received in the central passage 426 of each terminal 420 to electrically connect each terminal 420 with one of the resistors 400 via contact between each terminal 420 and one of the leads 402. In some embodiments, leads 402 may be inserted into central passages 426 of terminals 420 and the outer surface of each terminal 420 may be crimped to one of the leads 402 at the upper end 422 thereof to frictionally couple each terminal 420 with a corresponding lead 402. Additionally, an outer surface of each terminal 420 sealingly engages or contacts an inner surface of one of the passages 376 of grommet 370 to prevent fluid communication or flow through each passage 376. In other embodiments, terminals 420 may not comprise central passages 426 and terminals 420 may instead couple with leads 402 via another coupling mechanism. In still other embodiments, terminals 420 may be integrally or monolithically formed with leads 402.

In some embodiments, grommet 370 may be molded to leads 402 and terminals 420 following the crimping of terminals 420 to leads 402 to thereby form the molded grommet 370 about terminals 420 and the leads 402 of resistors 400. Following the molding of grommet 370 to terminals 420 and leads 402, grommet 370 may be inserted into the open end 356 of housing 352 to position grommet 376 and terminals 420 partially within the chamber 358 of housing 352.

Following the insertion of grommet 370 into open end 356, the outer surface 360 of housing 352 may be crimped at one or more locations therealong and proximal to open end 356, thereby forming grooves 362 in outer surface 360. The crimping of housing 352 compresses the outer surface of grommet 370 against the inner surface of housing 352, thereby frictionally coupling grommet 370 with housing 352 whereby relative axial movement therebetween is restricted. Additionally, the crimping of housing 352 compresses the inner surface of each passage 376 against one of the terminals 420, thereby frictionally coupling terminals 420 with grommet 370 and restricting relative axial movement between grommet 370 and terminals 420.

In this exemplary embodiment, terminals 420 are formed from wires which have been cut to a desired length and from which electrical insulation has been stripped such that terminals 420 form pins which may be stabbed into a corresponding plurality or pair of sockets to form an electrical connection therebetween. As will be described further herein, following the assembly of detonator 350, the lower ends of 424 of terminals 420 may be axially inserted into switch assembly 450 to electrically connect detonator 350 with switch assembly 450 whereby a firing signal may be transmitted from switch assembly 450 to detonator 350.

Figure 12:
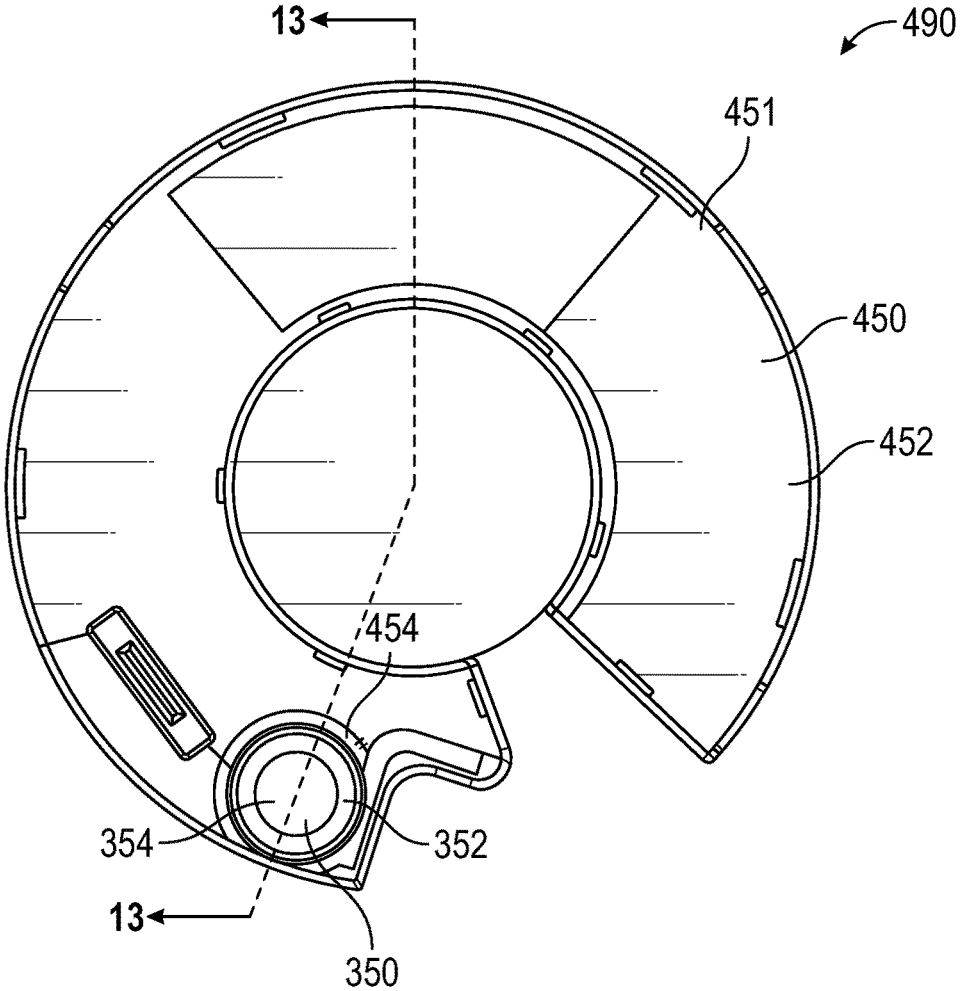
FIG. 12 is an end view of an initiator assembly of the charge tube assembly of FIGS. 4, 5 according to some embodiments.
Figure 13:
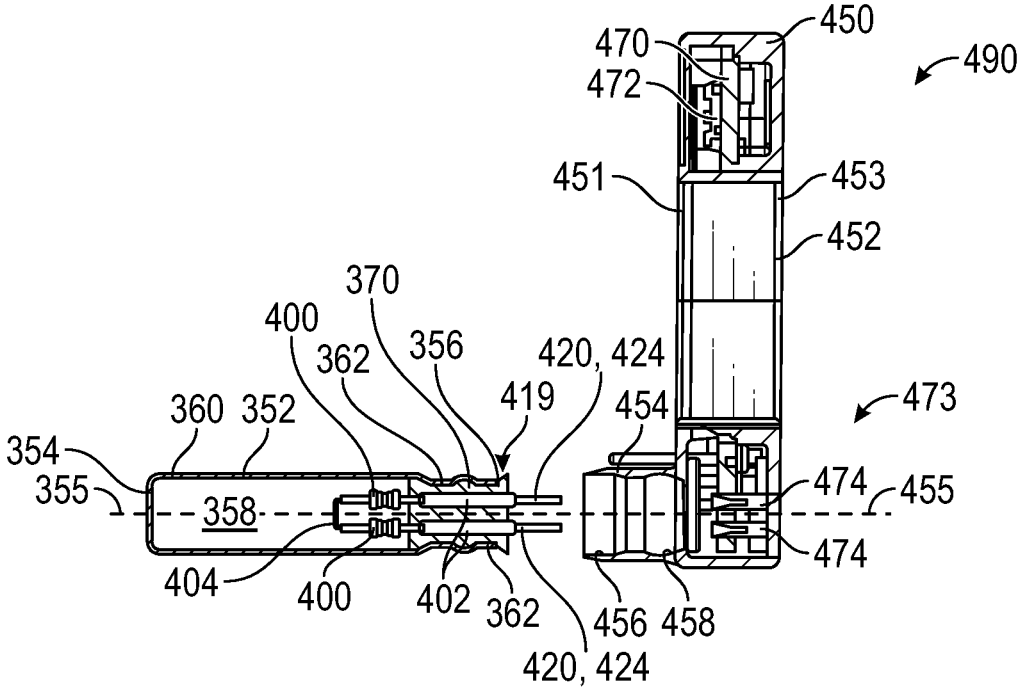
FIG. 13 is a cross-sectional view along lines 13-13 in FIG. 12 of the initiator assembly of FIG. 12 in a disconnected configuration.
Figure 14:
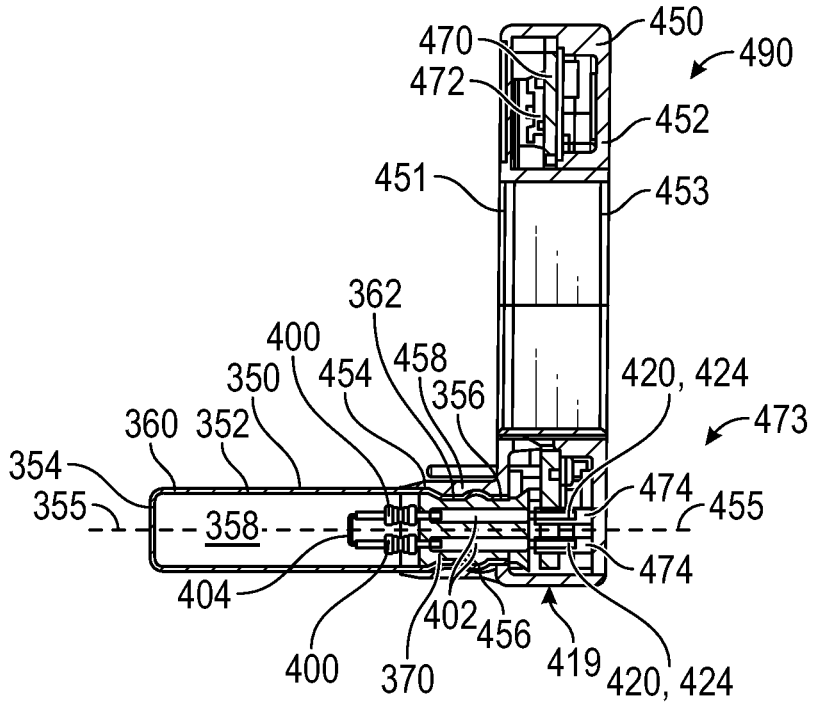
FIG. 14 is a cross-sectional view along lines 13-13 in FIG. 12 of the initiator assembly of FIG. 12 in a connected configuration.

Referring to FIGS. 12-14, the switch assembly 450 of perforating module 200A in this embodiment may be disc shaped (e.g., C-shaped) having a central opening through which electrical connector 273 of charge tube assembly 240 may extend. Switch assembly 450 generally comprises a switch housing 452 and a printed circuit board (PCB) 470 upon which a digital circuit 472 comprising one or more processors and one or more memory devices are provided. Additionally, PCB 470 includes an electrical connector 473 configured to electrically connect with the electrical connector 419 of detonator 350. In this exemplary embodiment, electrical connector 473 of PCB 470 comprises a female electrical connector 473 while electrical connector 419 of detonator 350 comprises a male electrical connector 419 which is insertable or stabbable into female electrical connector 473 to form an electrical connection between detonator 350 and switch assembly 450. Particularly, electrical connector 473 comprises a plurality or pair of electrical sockets 474 in which the terminals 420 of detonator 350 may be inserted or stabbed into.

Figure 15:
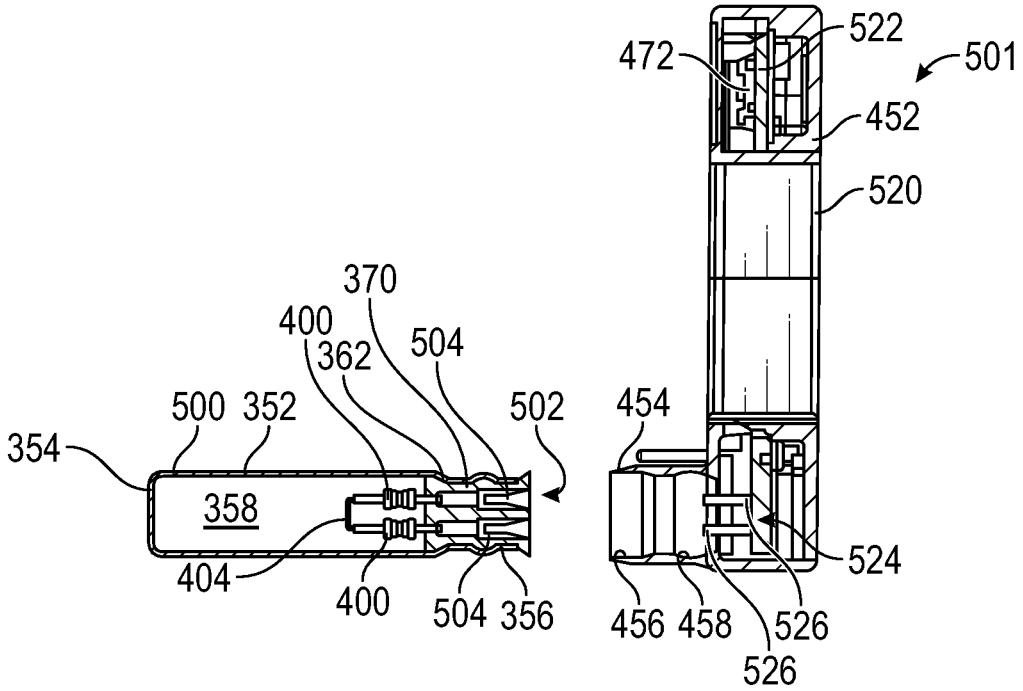
FIG. 15 is a cross-sectional view of another initiator assembly according to some embodiments.

In other embodiments, electrical connector 419 of detonator 350 may comprise a female electrical connector while electrical connector 473 of PCB 470 may comprise a male electrical connector insertable or stabbable into the female electrical connector of detonator 350. For example, referring briefly to FIG. 15, an embodiment of a detonator 500 and a switch assembly 520 are shown. Detonator 500 and switch assembly 520 shown in FIG. 15 include features in common with the detonator 350 and switch assembly 450 shown in FIGS. 4-14, and shared features are labeled similarly. Particularly, detonator 500 is similar to detonator 350 except that detonator 500 comprises a female electrical connector 502 comprising a pair of electrical sockets 504 positioned within detonator housing 352. Additionally, switch assembly 520 is similar to switch assembly 450 except that a PCB 522 of switch assembly 520 comprises a male electrical connector 524 including a pair of electrical terminals or pin connectors insertable or stabbable into the electrical sockets 504 of detonator 500 to form an electrical connection between detonator 500 and switch assembly 520. Detonator 500 and switch assembly 520 collectively comprise an initiator assembly 501 configured to fire or detonate the det cord 330 of charge tube assembly 240 after receiving a firing signal addressed to the initiator assembly 501.

In still other embodiments, electrical connectors 419, 473 may comprise radial connectors, leaf springs, or other types of electrical connectors configured to establish an electrical connection via physical or sliding contact therebetween. Electrical connectors 419, 473 may thus establish an electrical connection directly between the detonator 350 and switch assembly 450 without either needing to undergo the cumbersome and time-consuming process of wiring the detonator 350 to the switch assembly 450 or soldering the detonator 350 to the switch assembly 450 which could inadvertently initiate or fire the detonator 350. Thus, electrical connectors 419, 473 provide a mechanism for quickly and safely electrically connecting the detonator 350 to the switch assembly 450 in which one of electrical connectors 419, 473 need merely to be inserted into the other of the electrical connectors 419, 473 to establish an electrical connection therebetween.

Referring again to FIGS. 12-14, in this exemplary embodiment, switch housing 452 is arcuate in shape and houses or receives the PCB 470. Switch housing 452 may be releasably coupled to an external, annular face 286 of lower endplate 270 via a retaining mechanism or clip 288 of lower endplate 270. The thin, disc shape of switch assembly 450 serves to minimize the axial length of perforating module 200A, thereby minimizing the overall axial length of perforating gun 100, making the perforating gun 100 easier to transport through wellbore 4. While in this embodiment switch assembly 450 is positioned external of charge tube 242, in other embodiments, the switch assembly of perforating module 200A may be received within charge tube 242.

In this exemplary embodiment, switch housing 452 of switch assembly 450 comprises a first arcuate face 451, a second arcuate face 453 opposite first arcuate face 451, and a generally cylindrical detonator receptacle 454 projecting from the first arcuate face 451 and having a central or longitudinal axis 455 which extends parallel with, but is radially offset from, a central axis of switch assembly 450. Once assembled with charge tube 242, first arcuate face 451 of switch housing 452 may be positioned directly adjacent or contacting the lower endplate 270 of charge tube 242. Detonator receptacle 454 is configured to receive at least a portion of the detonator 350. In this exemplary embodiment, detonator receptacle 454 of switch housing 452 comprises a generally cylindrical inner surface 456 that includes one or more annular gripping surface or ridge 458. Ridge 458 of detonator receptacle 452 may assist with retaining detonator 350 within detonator receptacle 452 during the assembly of charge tube assembly 290. Following assembly of detonator 350 with switch assembly 450 whereby an electrical connection is established therebetween, detonator 350 and switch assembly 450 form an initiator assembly 490 of the charge tube assembly 240 configured to fire or detonate the det cord 330 of charge tube assembly 240 after receiving a firing signal addressed to the initiator assembly 490. While initiator assembly 490 is described herein as a component of perforating gun 100, in other embodiments, initiator assembly 490 may be utilized in perforating guns which differ in configuration from perforating gun 100.

Figure 16:
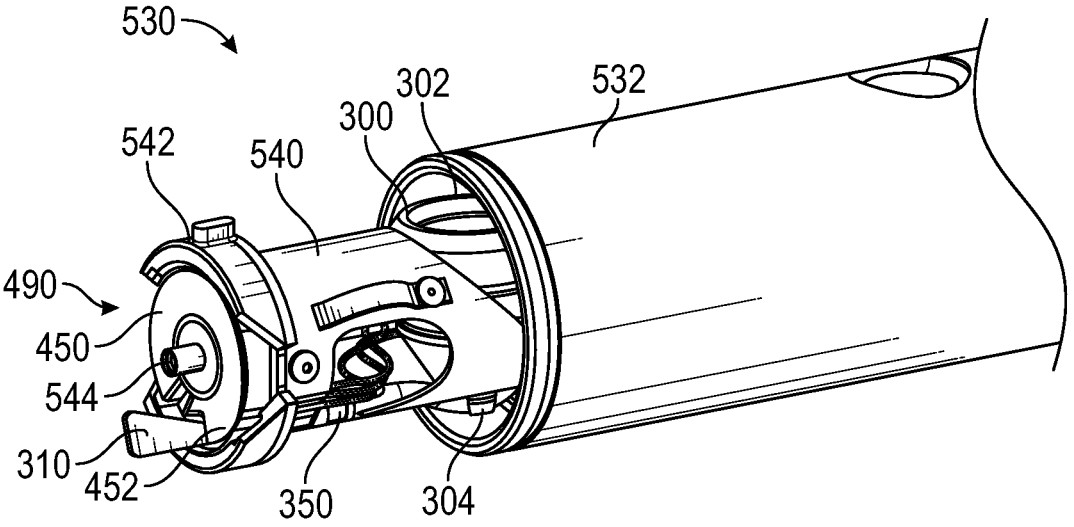
FIG. 16 is a partial exploded view of another perforating gun according to some embodiments.

As one example, initiator assembly 490 may be utilized in a perforating gun which does not include a plurality of separate perforating modules and which instead includes only a single charge tube assembly received in an outer gun or charge tube carrier. For instance, referring briefly to FIG. 16, a perforating tool or gun 530 is shown comprising an outer housing or carrier 532 and a charge tube assembly 540 receivable in the carrier 532 which comprises initiator assembly 490. Carrier 532 comprises a central passage in which the charge tube assembly 540 is received and which is sealed from the surrounding environment. Charge tube assembly 540 comprises a cylindrical charge tube 542 which receives a plurality of the shaped charges 300. Additionally, charge tube assembly 540 comprises an endplate 542 which couples to the initiator assembly 490 whereby the detonator 350 of initiator assembly 490 is received within charge tube 542. Endplate 542 comprises an electrical connector 544 in signal communication with initiator 490 following the coupling of initiator assembly 490 with endplate 542.

Referring again to FIGS. 12-14, following the assembly of detonator 350 and switch assembly 450, the central axis 355 of detonator 350 may be aligned with the central axis 455 of the detonator receptacle 454 of switch housing 452, as shown particularly in FIG. 13. The open end 356 of the detonator housing 352 of detonator 350 may then be stabbed or inserted into detonator receptacle 454 whereby terminals 420 of detonator 350 are axially inserted into the electrical sockets 474 of PCB 470 to establish an electrical connection between detonator 350 and switch assembly 450. Additionally, as detonator housing 352 is inserted into detonator receptacle 454, receptacle 454 may flex radially outwards and/or detonator housing 352 may flex radially inwards whereby the ridge 458 of detonator receptacle 454 interlocks with one of the grooves 362 of detonator housing 352 to retain detonator 350 to switch assembly 450. The interlocking engagement between ridge 458 and groove 362 may prevent vibrations or other forces applied to detonator 350 and switch assembly 450 during the operation of perforating module 200A from inadvertently disconnecting detonator 350 from switch assembly 450.

In this exemplary embodiment, PCB 470 of switch assembly 450 additionally includes a plurality of pin contacts 481, 482, and 483 which electrically connect and are received within the electrical connectors 285, 287, and 289, respectively, of wiring harness 284 to provide signal communication between electrical connector assemblies 252, 274, ground spring 249, and switch assembly 450. Detcord 330 of charge tube assembly 240 extends from detcord receptacle 281 to a pair of forks defining the second end 304 of shaped charge 300 to ballistically couple detonator 350 with shaped charge 300. In this configuration, the detonation of detonator 350 after receiving an appropriate firing signal from switch assembly 450 causes detcord 330 to ignite or detonate, which in-turn ignites or detonates the shaped charge 300 of perforating module 200A.

Interrupter 310 is slidably received in interrupter receptacle 282 of lower endplate 270. Interrupter 310 is configured to selectably block or interrupt the ballistic coupling between detonator 310 and detcord 330 so that perforating module 200A may be safely transported between a location of the assembly of perforating module 200A (located remotely from wellbore 4) and the site of wellbore 4. Particularly, interrupter 310 may be inserted into interrupt receptacle 281 prior to transporting perforating module 200A to the site of wellbore 4. With interrupter 310 received in interrupt receptacle 281, interrupter 310 serves to prevent the ignition or detonation of detcord 330 following an inadvertent detonation of detonator 350 so that shaped charge 300 is not inadvertently fired. After arriving at wellbore 4, and prior to the final assembly and running of perforating gun 100 into wellbore 4, interrupter 310 may be removed from interrupt receptacle 281 to allow for the ballistic coupling of detonator 350 and detcord 330 whereby detcord 330 will ignite following the ignition of detonator 350. In this embodiment, interrupter 310 comprises an elongate strip formed from a metallic material; however, in other embodiments, the configuration of interrupter 310 may vary. In still other embodiments, upper perforating module 200A may not include an interrupter.

In this embodiment, ground spring 249, which is electrically connected with charge tube 242, is biased into physical contact with the inner surface 204 of the carrier 202 of upper perforating module 200A to provide a ground path between ground spring 249 and carrier 202. The ground path may further extend uphole from carrier 202 via physical contact between the carrier 202 of upper perforating module 200A and upper pressure bulkhead 120, and physical contact between upper pressure bulkhead 120 and direct connect sub 28. Switch assembly 450 may also be grounded to carrier 202 of upper perforating module 200A via the electrical cable extending between the third electrical connector 289 (electrically connected to switch assembly 450) of wiring harness 284 and ground spring 249 which is coupled to (e.g., riveted, etc.) to charge tube 242 of charge tube assembly 240.

Figure 17:
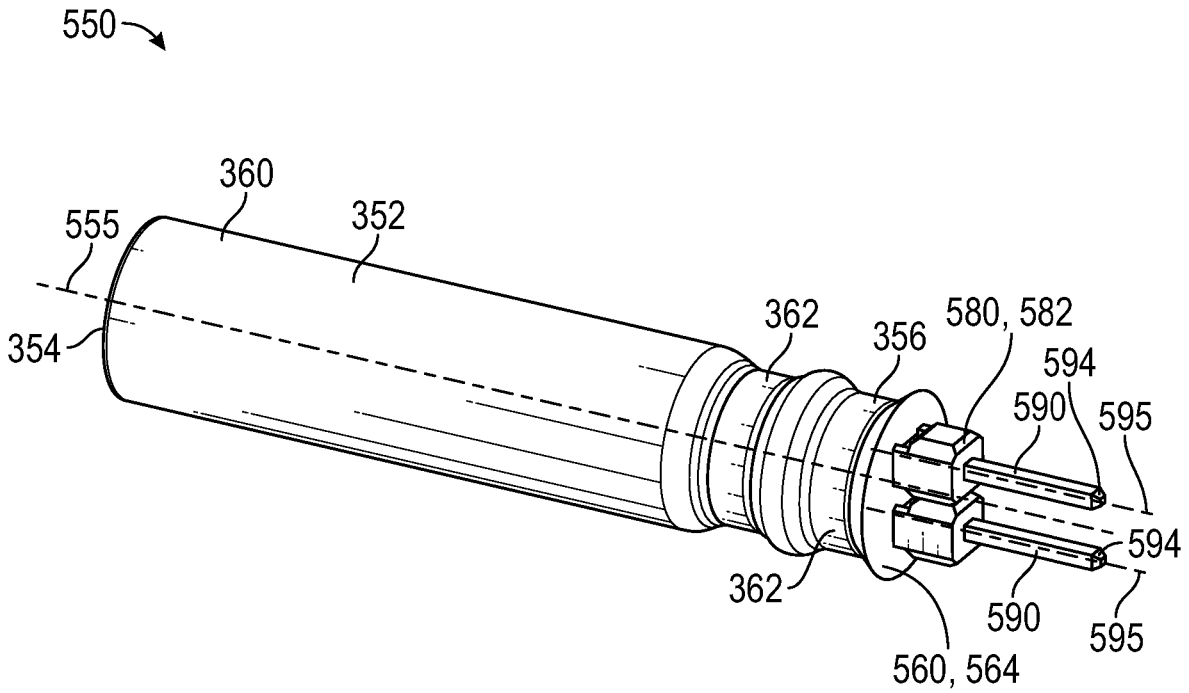
FIG. 17 is a perspective view of an alternative detonator of the charge tube assembly of FIGS. 4, 5 according to some embodiments.
Figure 18:
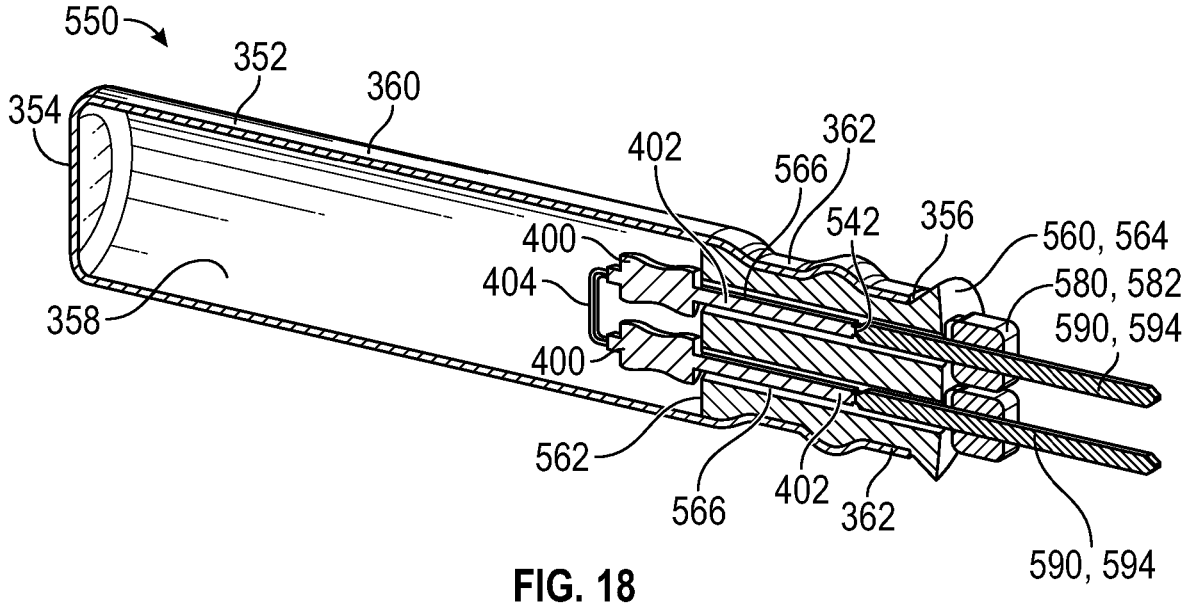
FIG. 18 is a cross-sectional, perspective view of the detonator of FIG. 17.

Referring to FIGS. 17, 18, another embodiment of a detonator 550 of charge tube assembly 240 is shown. Detonator 550 may be used in lieu of detonator 350 shown in FIGS. 17, 18 in the charge tube assembly 240 described above. Additionally, detonator 550 may include features in common with the detonator 350 shown particularly in FIGS. 10, 11, and shared features are labeled similarly. In this embodiment, detonator 550 has a longitudinal or central axis 555 and generally includes housing 352, a grommet 560, resistors 400 including leads 402, and a terminal block 580. Grommet 560 of detonator 550 comprises a first or upper end 562, a second or lower end 564 opposite upper end 562, and a pair of axial passages 566 extending between upper end 562 and lower end 564. The upper end 562 of grommet 560 is received in chamber 358 of housing 352 while lower end 564 is positioned external of chamber 358 such grommet 560 extends outwardly from the open end 356 of housing 352.

In this exemplary embodiment, the terminal block 580 of detonator 550 includes a connector header 582 molded to a pair of terminals 590. In other embodiments, terminals 590 may be slid into connector header 582 rather than molded thereto. Each terminal 590 of terminal block 580 has a central or longitudinal axis 596, a first or upper end 592, and a second or lower end 594 opposite upper end 592. In this embodiment, the central axis 595 of each terminal 590 is rectilinear. Additionally, the central axis 595 of each terminal 590 is offset from but extends parallel with the central axis 555 of detonator 550. In this embodiment, rather than being crimped to the leads 402 of resistors 400, terminals 590 of terminal block 580 are mechanically connected to leads 402. For example, in some embodiments, the upper ends 592 of terminals 590 may be soldered to leads 402. In other embodiments, a pair of barrel connectors (not shown in FIGS. 17, 18) may be crimped to the upper ends 592 of terminals 590 and leads 402 to mechanically connect terminals 590 with leads 402.

Referring generally to FIGS. 12-18, unlike conventional detonators, which often utilize flexible wires or cables to connect the detonator with a switch for firing the detonator, detonators 350, 500, and 550 described above are configured to connect with switch assembly 450 via rectilinear terminals 420, 590, and electrical sockets 504. In this manner, the electrical connection between detonators 350, 500, 550 and switch assembly 450 may occur directly adjacent to the endface 271 of lower endplate 270, eliminating the need for any additional axial space (i.e., space extending axially beyond endface 271 of lower endplate 270) for the wiring of the connection between detonators 350, 500, 550 and switch assembly 450. Thus, by connecting detonator 350, 500, or 550 with switch assembly 450 via terminals 420, 590 respectively, the axial length of charge tube assembly 240 may be minimized, in-turn minimizing the axial length of perforating gun 100. In embodiments where the switch assembly to which detonator 350, 500, 550 is connected comprises lead wires (having a receptacle connected thereto), terminals 420, 590, respectively, may be directly connected to the receptacle of the switch assembly (or terminals 526 of switch assembly 520 may be connected to sockets 504 of detonator 500) to thereby prevent a user of perforating gun 100 from having to connected lead wires of a conventional detonator to the lead wires of the switch assembly with a Skotchlok or similar connection which are prone to being installed incorrectly.

Detonators 350, 500, and 550 also provide additional advantages other than the minimization of the axial length of perforating gun 100 and tool string 20 relative to conventional systems. For instance, by connecting either detonators 350 or 550 to switch assembly 450 via terminals 420, 590 or by connecting detonator 500 to switch assembly 520 via electrical sockets 504, an additional connection point (required in conventional systems relying on wired detonator assemblies) may be eliminated, thereby increasing the reliability of perforating gun 100. In some embodiments, a COTS jumper may be installed on the terminals 420, 590 of detonators 350, 500, 550 (prior to connecting detonators 300, 500, and 550 with a corresponding switch assembly), respectively, to short the detonator 350, 500, 550 (or inserted onto sockets 504 of detonator 500) for safe handling and transport of perforating gun 100.

In this embodiment, the switch assemblies 450 of perforating modules 200A-200C are individually addressable by the firing panel for firing their respective shaped charges 300. For example, once perforating gun 100 is positioned in wellbore 4, the firing panel of surface assembly 11 may assign each switch assembly 450 of perforating modules 200A-200C with a unique identifier so that the firing panel may communicate selectably between each perforating module 200A-200C. Thus, following the assignment of identifiers to switch assemblies 450 of perforating modules 200A-200C, perforating gun 100 may be positioned at a first location within wellbore 4. With perforating gun 100 positioned at the first location, the firing panel may instruct only lower perforating module 200C to fire, causing the shaped charge 300 of lower perforating module 200C to detonate and thereby perforate casing string 12 at the first location in wellbore 4. Following the perforation of casing string 12 at the first location, perforating gun 100 may be transported uphole towards the surface 5 until perforating gun 100 is positioned in a second location in wellbore 4 which is spaced from the first location. With perforating gun 100 positioned at the second location, the firing panel may instruct only central perforating module 200B to fire, causing the shaped charge 300 of central perforating module 200B to detonate and thereby perforate casing string 12 at the second location in wellbore 4. Finally, following the perforation of casing string 12 at the second location, perforating gun 100 may be transported uphole towards the surface 5 until perforating gun 100 is positioned in a third location in wellbore 4 which is spaced from the first and second locations. With perforating gun 100 positioned at the third location, the firing panel may instruct only upper perforating module 200A to fire, causing the shaped charge 300 of upper perforating module 200A to detonate and thereby perforate casing string 12 at the third location in wellbore 4.

Figure 19:
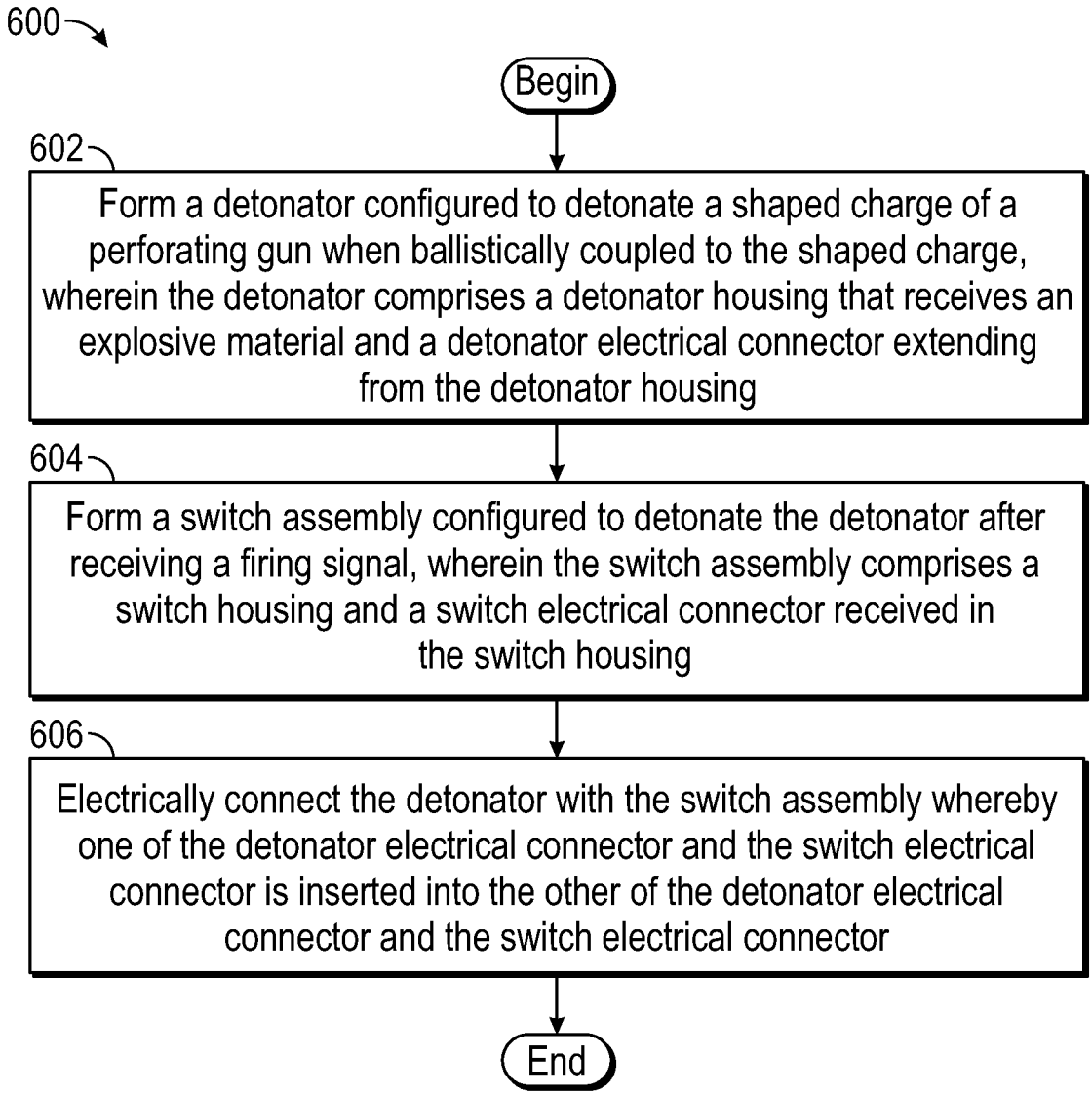
FIG. 19 is a flow chart of a method for assembling an initiator assembly for a perforating gun according to some embodiments.

Referring to FIG. 19, an embodiment of a method 600 for assembling an initiator assembly for a perforating gun is shown. Beginning at block 602, method 600 comprises forming a detonator (e.g., detonators 350, 500, and 550) configured to detonate a shaped charge of the perforating gun when ballistically coupled to the shaped charge, wherein the detonator comprises a detonator housing that receives an explosive material and a detonator electrical connector (e.g., electrical connectors 419, 502) extending from the detonator housing. In some embodiments, the detonator electrical connector may be a male electrical connector comprising a pair of electrical terminals or pins while in other embodiments the detonator electrical connector may be a female electrical connector comprising a pair of electrical sockets. In some embodiments, the detonator may be ballistically coupled directly to the shaped charge while in other embodiments the detonator may be ballistically coupled to the shaped charge via a det cord.

At block 604, method 600 comprises forming a switch assembly (e.g., switch assemblies 450, 520) configured to detonate the detonator after receiving a firing signal, wherein the switch assembly comprises a switch housing and a switch electrical connector (e.g., electrical connectors 473, 524) received in the switch housing. In some embodiments, the firing signal may close the switch assembly whereby a firing voltage may be applied to the detonator when connected therewith to thereby detonate the detonator. In some embodiments, the switch electrical connector may be a female electrical connector comprising a pair of electrical sockets while in other embodiments the switch electrical connector may be a male electrical connector comprising a pair of electrical terminals or ins. At block 606, method 600 comprises electrically connecting the detonator with the switch assembly whereby one of the detonator electrical connector and the switch electrical connector is inserted into the other of the detonator electrical connector and the switch electrical connector. In some embodiments, block 606 comprises electrically connecting the detonator with the switch assembly whereby the detonator electrical connector slidably electrically contacts the switch electrical connector.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An initiator assembly for a perforating gun, comprising:

a detonator configured to detonate a shaped charge of the perforating gun when ballistically coupled to the shaped charge, wherein the detonator comprises a detonator housing having a central axis and comprising an internal chamber and an outer cylindrical surface having an annular groove formed thereon, an explosive material positioned within the internal chamber, and a first portion of an electrical circuit comprising an initiator positioned within the internal chamber and a detonator electrical connector extending from the detonator housing and both physically and electrically connected to the initiator; and a switch assembly configured to detonate the detonator after receiving a firing signal, wherein the switch assembly comprises a switch housing having a central axis that is offset from the central axis of the detonator housing and including a detonator receptacle configured to couple with the detonator housing whereby a majority of the detonator housing is located external the switch housing when the detonator housing is coupled with the detonator receptacle, and a second portion of the electrical circuit comprising a switch electrical connector positioned in the switch housing, wherein the detonator receptacle comprises an inner cylindrical surface having an annular ridge formed thereon and configured to interlock with the annular groove of the detonator housing to retain the detonator housing with the detonator receptacle;

wherein one of the detonator electrical connector and the switch electrical connector comprises a pair of electrical terminals that are insertable into the other of the detonator electrical connector and the switch electrical connector to complete the electrical circuit whereby the switch electrical connector is both physically and electrically connected to the initiator, and wherein the pair of electrical terminals are configured to detonate the explosive material in response to being electrically energized.

2. The initiator assembly of claim 1, wherein the detonator electrical connector is insertable into the switch electrical connector to complete the electrical circuit.

3. The initiator assembly of claim 1, wherein the detonator electrical connector comprises the pair of electrical terminals which extend from the detonator housing.

4. The initiator assembly of claim 3, wherein each of the pair of electrical terminals extends along a rectilinear central axis.

5. The initiator assembly of claim 3, wherein the pair of electrical terminals are receivable within a plurality of electrical sockets of the switch electrical connector.

6. The initiator assembly of claim 1, wherein the detonator electrical connector slidably electrically contacts the switch electrical connector when the detonator electrical connector is electrically connected to the switch electrical connector.

7. The initiator assembly of claim 1, wherein an uninterrupted electrical connection is formed between the pair of electrical terminals and at least one electrical resistor positioned within the detonator housing in response to the completion of the electrical circuit.

8. The initiator assembly of claim 1, wherein the pair of electrical terminals extend into the detonator housing when the electrical circuit is completed.

9. The initiator assembly of claim 1, wherein an uninterrupted electrical connection is formed between the initiator and the detonator electrical connector prior to the completion of the electrical circuit.

10. An initiator assembly for a perforating gun, comprising:

a detonator configured to detonate a shaped charge of the perforating gun when ballistically coupled to the shaped charge, wherein the detonator comprises a detonator housing having a central axis and comprising an internal chamber and an outer cylindrical surface having an annular groove formed thereon, an explosive material positioned within the internal chamber, and a first portion of an electrical circuit comprising an initiator positioned within the internal chamber and a detonator electrical connector extending from the detonator housing and both physically and electrically connected to the initiator; and a switch assembly configured to detonate the detonator after receiving a firing signal, wherein the switch assembly comprises a switch housing having a central axis that is offset from the central axis of the detonator housing and including a detonator receptacle configured to couple with the detonator housing whereby a majority of the detonator housing is located external the switch housing when the detonator housing is coupled with the detonator receptacle, and a second portion of the electrical circuit comprising a switch electrical connector positioned in the switch housing, wherein the detonator receptacle comprises an inner cylindrical surface having an annular ridge formed thereon and configured to interlock with the annular groove of the detonator housing to retain the detonator housing with the detonator receptacle;

wherein the detonator electrical connector slidably electrically contacts the switch electrical connector when the detonator electrical connector is electrically connected to the switch electrical connector to complete the electrical circuit whereby the switch electrical connector is both physically and electrically connected to the initiator, and wherein one of the detonator electrical connector and the switch electrical connector comprises a pair of electrical terminals configured to detonate the explosive material in response to being electrically energized.

11. The initiator assembly of claim 10, wherein the detonator electrical connector comprises the pair of electrical terminals which extend from the detonator housing.

12. The initiator assembly of claim 11, wherein each of the plurality of terminals extends along a rectilinear central axis.

13. The initiator assembly of claim 11, wherein the pair of electrical terminals are receivable within a plurality of electrical sockets of the switch electrical connector.

14. The initiator assembly of claim 11, wherein:

the initiator of the first portion of the electrical circuit comprises a plurality of electrical resistors, each resistor having a lead electrically connected to one of the pair of electrical terminals; and each of the pair of electrical terminals is mechanically connected to one of the leads of the resistors.

15. The initiator assembly of claim 10, wherein one of the detonator electrical connector and the switch electrical connector is insertable into the other of the detonator electrical connector and the switch electrical connector to complete the electrical circuit.

16. The initiator assembly of claim 10, wherein an uninterrupted electrical connection is formed between the pair of electrical terminals and at least one electrical resistor positioned within the detonator housing in response to the formation of the electrical connection between the detonator and the switch assembly.

17. The initiator assembly of claim 10, wherein the pair of electrical terminals extend into the detonator housing when the electrical circuit is completed.

18. The initiator assembly of claim 10, wherein an uninterrupted electrical connection is formed between the initiator and the detonator electrical connector prior to the completion of the electrical circuit.

19. A method of assembling an initiator assembly for a perforating gun, comprising:

(a) forming a detonator configured to detonate a shaped charge of the perforating gun when ballistically coupled to the shaped charge, wherein the detonator comprises a detonator housing having a central axis and comprising an internal chamber and an outer cylindrical surface having an annular groove formed thereon, an explosive material positioned within the internal chamber, and a first portion of an electrical circuit comprising an initiator positioned within the internal chamber and a detonator electrical connector extending from the detonator housing and both physically and electrically connected to the initiator;

(b) forming a switch assembly configured to detonate the detonator after receiving a firing signal, wherein the switch assembly comprises a switch housing having a central axis that is offset from the central axis of the detonator housing and including a detonator receptacle, and a second portion of the electrical circuit comprising a switch electrical connector positioned in the switch housing;

(c) coupling the detonator housing with the detonator receptacle of the switch housing whereby a majority of the detonator housing is located external the switch housing, wherein the coupling of the detonator housing with the detonator receptacle interlocks the annular ridge of the detonator receptacle with the annular groove of the detonator housing and thereby retains the detonator housing with the detonator receptacle; and (d) electrically connecting the detonator with the switch assembly in response to coupling the detonator housing partially with the detonator receptacle whereby a pair of electrical terminals of one of the detonator electrical connector and the switch electrical connector is inserted into the other of the detonator electrical connector and the switch electrical connector to complete the electrical circuit whereby the switch electrical connector is both physically and electrically connected to the initiator, wherein the pair of electrical terminals are configured to detonate the explosive material in response to being electrically energized.

20. The method of claim 19, wherein (a) comprises:

(a1) cutting a plurality of wires extending from the detonator housing to a predefined length; and (a2) stripping insulation from the plurality of wires to form the pair of electrical terminals which comprises the electrical connector of the detonator.

21. The method of claim 19, wherein (c) comprises inserting the pair of electrical terminals comprising the detonator electrical connector into a plurality of electrical sockets comprising the switch electrical connector.

22. The method of claim 19, wherein (d) comprises electrically connecting the detonator with the switch assembly whereby the detonator electrical connector slidably electrically contacts the switch electrical connector.

* * * * *